US005619003A

United States Patent [19]

Hotz

[11] Patent Number: 5,619,003

[45] Date of Patent: Apr. 8, 1997

[54] ELECTRONIC MUSICAL INSTRUMENT DYNAMICALLY RESPONDING TO VARYING CHORD AND SCALE INPUT INFORMATION

[75] Inventor: Jimmy C. Hotz, Thousand Oaks, Calif.

[73] Assignee: The Hotz Corporation, Thousand Oaks, Calif.

[21] Appl. No.: 597,340

[22] Filed: Feb. 6, 1996

Related U.S. Application Data

[63] Continuation of Ser. No. 254,447, Jun. 6, 1994, Pat. No. 5,502,274, which is a continuation of Ser. No. 84,745, Jun. 29, 1993, abandoned, which is a continuation of Ser. No. 820,761, Jan. 13, 1992, abandoned, which is a continuation of Ser. No. 447,381, Dec. 7, 1989, Pat. No. 5,099,738, which is a continuation of Ser. No. 292,966, Jan. 3, 1989, abandoned.

[51] Int. Cl.[6] ..... G10H 1/053; G10H 1/18; G10H 1/38

[52] U.S. Cl. ..... 84/615; 84/626; 84/637; 84/645; 84/DIG. 22

[58] Field of Search ..... 84/615–620, 626, 84/627, 633, 645, 658, 662–665, 723, 737–742, 477 R, 478, 613, 637, DIG. 22

[56] References Cited

U.S. PATENT DOCUMENTS

| | | | |
|---|---|---|---|
| 197,648 | 11/1877 | McChesney et al. . | |
| 2,253,782 | 8/1941 | Hammond et al. | 84/423 |
| 2,557,690 | 6/1951 | Reuther | 84/423 |
| 2,611,291 | 9/1952 | Heim | 84/427 |
| 3,789,192 | 1/1974 | Spindler | 219/522 |
| 3,958,207 | 5/1976 | Tutihasi | 338/15 |
| 4,064,758 | 12/1977 | Harrison | 73/398 |
| 4,103,274 | 7/1978 | Burgess et al. | 338/21 |
| 4,227,436 | 10/1980 | Kryzanowsky | 84/423 |
| 4,235,141 | 11/1980 | Eventoff | 84/1.01 |
| 4,268,815 | 5/1981 | Eventoff et al. | 338/69 |
| 4,276,538 | 6/1981 | Eventoff et al. | 338/69 |
| 4,295,406 | 10/1981 | Smith | 84/470 |
| 4,301,337 | 11/1981 | Eventoff | 200/5 |
| 4,306,480 | 12/1981 | Eventoff et al. | 84/1.01 |
| 4,311,980 | 1/1982 | Prudenziati | 338/4 |
| 4,314,227 | 2/1982 | Eventoff | 338/99 |
| 4,314,228 | 2/1982 | Eventoff | 338/114 |
| 4,315,238 | 2/1982 | Eventoff | 338/99 |
| 4,382,247 | 5/1983 | Stecher et al. | 338/42 |
| 4,385,525 | 5/1983 | Phillips et al. | 73/720 |

(List continued on next page.)

OTHER PUBLICATIONS

Ziegler, B. "It's A Guitar, It's A Player Piano, It's . .. Karoake Guitar"; *Business Week;* Aug. 9, 1993.

Greenstein, J.; "Move over, sing–along: here comes play–a-long"; Perspectives; *Video Business,* Sep. 3, 1993; p. 38.

"Virtual Guitar Game Set"; *Twice;* Dec. 27, 1993; p. 47.

"The Key™" (four page document), Manual; 1993/1994; (see BM and BN).

"MIDI 1.0 Detailed Specification"; pp. 1–59 (text); 1 page of drawing.

Ex parte S (Board of Appeals) Aug. 4, 1943 (Case No. 109); *Journal of the Patent Office Society.*

*Primary Examiner*—Stanley J. Witkowski

*Attorney, Agent, or Firm*—D'Alessandro & Ritchie

[57] ABSTRACT

An electronic musical instrument having keys that include a first set of keys for generating program commands in real time such as chord and scale selections in response to being depressed, and a second set of keys for generating input device signals in response to being played. The electronic musical instrument also has a memory adapted to store a plurality of translation tables. The translation tables being adapted to translate the input device signals received from the second set of keys into corresponding control signals. A translator to the input device signals, the translation tables, and the program commands generating control signals which are used by an electronic signal generator. The electronic musical interface also includes an interface for providing access between the translator and at least one external device.

17 Claims, 21 Drawing Sheets

Microfiche Appendix Included
(72 Microfiche, 2 Pages)

U.S. PATENT DOCUMENTS

| | | | |
|---|---|---|---|
| 4,428,269 | 1/1984 | Bione et al. | 84/1.01 |
| 4,433,601 | 2/1984 | Hall et al. | 84/1.03 |
| 4,451,714 | 5/1984 | Eventoff | 200/5 A |
| 4,481,497 | 11/1984 | Kurtz et al. | 338/2 |
| 4,489,302 | 12/1984 | Eventoff | 338/99 |
| 4,508,002 | 4/1985 | Hall et al. | 84/1.03 |
| 4,513,650 | 4/1985 | Nagasaka et al. | 84/1.03 |
| 4,535,317 | 8/1985 | Canet et al. | 338/36 |
| 4,543,869 | 10/1985 | Kawashira et al. | 84/1.01 |
| 4,589,287 | 5/1986 | Dickens | 73/727 |
| 4,596,032 | 6/1986 | Sakurai | 381/51 |
| 4,635,517 | 1/1987 | Nagashima et al. | 84/1.01 |
| 4,643,066 | 2/1987 | Oya | 84/1.01 |
| 4,644,840 | 2/1987 | Franz et al. | 84/1.01 |
| 4,646,609 | 3/1987 | Teruo et al. | 84/1.01 |
| 4,658,695 | 4/1987 | Cutler | 84/424 |
| 4,682,526 | 7/1987 | Hall et al. | 84/1.03 |
| 4,686,880 | 8/1987 | Salani et al. | 84/1.01 |
| 4,703,680 | 11/1987 | Wachi et al. | 84/1.26 |
| 4,711,148 | 12/1987 | Takeda et al. | 84/1.01 |
| 4,736,333 | 4/1988 | Mead et al. | 364/736 |
| 4,739,299 | 4/1988 | Eventoff et al. | 338/99 |
| 4,748,887 | 6/1988 | Marshall | 845/1.15 |
| 4,765,218 | 8/1988 | Eppinger | 84/1.01 |
| 4,766,795 | 8/1988 | Takeuchi | 84/1.01 |
| 4,771,671 | 9/1988 | Hoff, Jr. | 84/1.01 |
| 4,776,253 | 10/1988 | Downes | 84/1.01 |
| 4,777,857 | 10/1988 | Stewart | 84/1.01 |
| 4,786,764 | 11/1988 | Padula et al. | 178/18 |
| 4,794,838 | 1/1989 | Corrigau, III | 84/1.01 |
| 4,799,381 | 1/1989 | Tromp | 73/146 |
| 4,810,992 | 3/1989 | Eventoff | 338/99 |
| 4,838,089 | 6/1989 | Okada et al. | 73/727 |
| 4,942,551 | 7/1990 | Klappert et al. | 364/900 |
| 4,963,702 | 10/1990 | Yaniger et al. | 178/18 |
| 4,974,596 | 12/1990 | Frank | 128/672 |
| 5,034,720 | 7/1991 | Bell et al. | 338/219 |
| 5,053,585 | 10/1991 | Yaniger | 178/18 |
| 5,099,738 | 3/1992 | Hotz | 84/617 |
| 5,107,710 | 4/1992 | Huck et al. | 73/708 |
| 5,115,705 | 5/1992 | Monte et al. | 84/617 |
| 5,231,488 | 7/1993 | Mohrbacher et al. | 358/139 |
| 5,440,071 | 8/1995 | Johnson | 84/673 |

Quit  Hotz Translator Copyright 1988 Hotz Instruments Technology

B MINOR  Globals  Load  Save  Init  Copy  Fill

FLEETWOOD MAC DEMO ver1  SCRN12RF.MPS

| | | | | | | | | | | | | | | | | | | | | | | | |
|---|---|---|---|---|---|---|---|---|---|---|---|---|---|---|---|---|---|---|---|---|---|---|---|
| C | | C# | | D | | D# | | E | | F | | F# | | G | | G# | | A | | A# | | B | |
| C | m | C# | m | D | m | D# | m | E | m | F | m | F# | m | G | m | G# | m | A | m | A# | m | B | m |
| C | dim | C#dim | | D | dim | D#dim | | E | dim | F | dim | F#dim | | G | dim | G#dim | | A | dim | A#dim | | B | dim |
| C | aug | C#aug | | D | aug | D#aug | | E | aug | F | aug | F#aug | | G | aug | G#aug | | A | aug | A#aug | | B | aug |
| C | sus | C#sus | | D | sus | D#sus | | E | sus | F | sus | F#sus | | G | sus | G#sus | | A | sus | A#sus | | B | sus |
| C | 7 | C# | 7 | D | 7 | D# | 7 | E | 7 | F | 7 | F# | 7 | G | 7 | G# | 7 | A | 7 | A# | 7 | B | 7 |
| C | M7 | C#M7 | | D | M7 | D#M7 | | E | M7 | F | M7 | F#M7 | | G | M7 | G#M7 | | A | M7 | A#M7 | | B | M7 |
| C | m7 | C#m7 | | D | m7 | D#m7 | | E | m7 | F | m7 | F#m7 | | G | m7 | G#m7 | | A | m7 | A#m7 | | B | m7 |

| | | | | | | | | | | | | | | | | | | | | | | | |
|---|---|---|---|---|---|---|---|---|---|---|---|---|---|---|---|---|---|---|---|---|---|---|---|
| A | | sG | m | C | | C | | | | | | | | | | | | | | | | | |
| E/G | | sG | m+3 | D | m | C | aug | | | | | | | | | | | | | | | | |
| C#m | | sF | | E | m | C | sus | | | | | | | | | | | | | | | | |
| | | sD# | | F | | D | aug | | | | | | | | | | | | | | | | |
| | | A# | | G | | D | sus | | | | | | | | | | | | | | | | |
| B | susF | m | A | m | D | | | | | | | | | | | | | | | | | | |
| C#m7 | nF | m7 | C | susE | | | | | | | | | | | | | | | | | | | |
| C#m7 | uC | 9m | C | augE | sus | | | | | | | | | | | | | | | | | | |

D MAJOR  Delete/Format  Load  Save  Init  Copy  Fill

HOTZ LIBRARY DISK 7721  SCRN11RF.MPS

| | | | | | | | | | | | | | | | | | | | | | | | |
|---|---|---|---|---|---|---|---|---|---|---|---|---|---|---|---|---|---|---|---|---|---|---|---|
| C#9M | E | 9M | F | 9M | F#9M | G | 9M | G#9M | A | 9M | A#9M | B | 9M | C | 9M | C#9M | D | 9M | A | M7 | A | | F |
| C#9m | E | 9m | F | 9m | F#9m | G | 9m | G#9m | A | 9m | A#9m | B | 9m | C | 9m | C#9m | D | 9m | G | M7 | G | m | F |
| C#11M | E | 11M | F | 11M | F#11M | G | 11M | G#11M | A | 11M | A#11M | B | 11M | C | 11M | C#11M | D | 11M | F | M7 | F | m | F |
| C#11m | E | 11m | F | 11m | F#11m | G | 11m | G#11m | A | 11m | A#11m | B | 11m | C | 11m | C#11m | D | 11m | G | m7 | E | 11m | F |
| C#13M | E | 13M | F | 13M | F#13M | G | 13M | G#13M | A | 13M | A#13M | B | 13M | C | 13M | C#13M | D | 13M | F | m7 | G | m7 | G |
| C#13m | E | 13m | F | 13m | F#13m | G | 13m | G#13m | A | 13m | A#13m | B | 13m | C | 13m | C#13m | D | 13mA | | M7 | F | m7 | F |
| C#-5 | E | -5 | F | -5 | F#-5 | G | -5 | G#-5 | A | -5 | A#-5 | B | -5 | C | -5 | C#-5 | D | -5 | A | M7 | G | M7 | A |
| C | +5 | C#+5 | | D | +5 | D#+5 | | E | +5 | F | +5 | F#+5 | | G | +5 | G#+5 | | A | +5 | A#+5 | | B | +5 |

| | | | | | | | | | | | | | | | | | | | | | | | |
|---|---|---|---|---|---|---|---|---|---|---|---|---|---|---|---|---|---|---|---|---|---|---|---|
| 9M | A | m | | | | | | | | | | | | | | | | | | | | | |
| 9m | G | | | | | | | | | | | | | | | | | | | | | | |
| 11MF | | | | | | | | | | | | | | | | | | | | | | | |
| 11mE | m | | | | | | | | | | | | | | | | | | | | | | |
| M7 | F#13M | | | | | | | | | | | | | | | | | | | | | | |
| 13mF | #13m | | | | | | | | | | | | | | | | | | | | | | |
| M7 | A | M7 | A | M7 | | | | | | | | | | | | | | | | | | | |
| M7 | D | A | M7 | | | | | | | | | | | | | | | | | | | | |

FIG.-6a

Quit Hotz Translator Copyright 1988 Hotz Instruments Technology

C MAJOR | Globals | Load | Save | Init | Copy | Fill

FLEETWOOD MAC DEMO ver1 | FLLEETW11.MPS

| | | | | | | | | | | | | | | | |
|---|---|---|---|---|---|---|---|---|---|---|---|---|---|---|---|
| 001 | 002 | 003 | 004 | 005 | 006 | 007 | 008 | 009 | 010 | 011 | 012 | 013 | 014 | 015 | 016 |
| 017 | 018 | 019 | 020 | 021 | 022 | 023 | 024 | 025 | 026 | 027 | 028 | 029 | 030 | 031 | 032 |
| 033 | 034 | 035 | 036 | 037 | 038 | 039 | 040 | 041 | 042 | 043 | 044 | 045 | 046 | 047 | 048 |
| 049 | 050 | 051 | 052 | 053 | 054 | 055 | 056 | 057 | 058 | 059 | 060 | 061 | 062 | 063 | 064 |
| 065 | 066 | 067 | 068 | 069 | 070 | 071 | 072 | 073 | 074 | 075 | 076 | 077 | 078 | 079 | 080 |
| 081 | 082 | 083 | 084 | 085 | 086 | 087 | 088 | 089 | 090 | 091 | 092 | 093 | 094 | 095 | 096 |
| 097 | 098 | 099 | 100 | 101 | 102 | 103 | 104 | 105 | 106 | 107 | 108 | 109 | 110 | 111 | 112 |
| 113 | 114 | 115 | 116 | 117 | 118 | 119 | 120 | 121 | 122 | 123 | 124 | 125 | 126 | 127 | 128 |

C MAJOR | Delete/Format | Load | Save | Init | Copy | Fill

HOTZ LIBRARY DISK 7721 | NOTZ7721.MPS

| | | | | | | | | | | | | | | | |
|---|---|---|---|---|---|---|---|---|---|---|---|---|---|---|---|
| 001 | 002 | 003 | 004 | 005 | 006 | 007 | 008 | 009 | 010 | 011 | 012 | 013 | 014 | 015 | 016 |
| 017 | 018 | 019 | 020 | 021 | 022 | 023 | 024 | 025 | 026 | 027 | 028 | 029 | 030 | 031 | 032 |
| 033 | 034 | 035 | 036 | 037 | 038 | 039 | 040 | 041 | 042 | 043 | 044 | 045 | 046 | 047 | 048 |
| 049 | 050 | 051 | 052 | 053 | 054 | 055 | 056 | 057 | 058 | 059 | 060 | 061 | 062 | 063 | 064 |
| 065 | 066 | 067 | 068 | 069 | 070 | 071 | 072 | 073 | 074 | 075 | 076 | 077 | 078 | 079 | 080 |
| 081 | 082 | 083 | 084 | 085 | 086 | 087 | 088 | 089 | 090 | 091 | 092 | 093 | 094 | 095 | 096 |
| 097 | 098 | 099 | 100 | 101 | 102 | 103 | 104 | 105 | 106 | 107 | 108 | 109 | 110 | 111 | 112 |
| 113 | 114 | 115 | 116 | 117 | 118 | 119 | 120 | 121 | 122 | 123 | 124 | 125 | 126 | 127 | 128 |

FIG.-6h

ELECTRONIC MUSICAL INSTRUMENT DYNAMICALLY RESPONDING TO VARYING CHORD AND SCALE INPUT INFORMATION

CROSS REFERENCE TO RELATED APPLICATIONS

This is a continuation of U.S. patent application Ser. No. 08/254,447, filed Jun. 6, 1994, now U.S. Pat. No. 5,502,274 which is a continuation of U.S. patent application Ser. No. 08/084,745, filed Jun. 29, 1993, now abandoned, which was in turn, a continuation of U.S. patent application Ser. No. 07/820,761, filed Jan. 13, 1992, now abandoned,which is a continuation of Ser. No. 07/447,381 filed Dec. 7, 1989 now U.S. Pat. No. 5,099,738, which was, in turn, a continuation of U.S. patent application Ser. No. 07/292,966 filed Jan. 3, 1989, now abandoned. The complete disclosures of all of the foregoing patent(s) and patent applications are hereby incorporated herein by reference as if set forth fully herein.

This application relates to Disclosure Document No. 200720 received by the United States Patent and Trademark Office on Sep. 7, 1988. A two page microfiche appendix A of 72 frames is attached to the application file.

BACKGROUND OF THE INVENTION

1. Field of the Invention

The present invention relates generally to electronic musical instruments. More particularly, the present invention relates to a versatile user-programmable musical instrument with the capability of transparently altering pitch and velocity for the user, so that only correct values relating to scale and chord value are available at any given moment.

2. The Prior Art

Electronic keyboard and other electronic musical instruments are known in the prior art. Also known are electronic musical keyboard instruments which generate tone and velocity information compatible with the MIDI (Musical Instrument Digital Interface) standard which has come into wide usage in recent years. Numerous keyboard instruments, such as those manufactured by Roland, provide a powerful measure of performance.

Electronic musical instruments which provide for an automatic accompaniment to be generated by the instrument in response to a performer playing the instrument are also known in the art. Examples of such instruments are found in U.S. Pat. Nos. 4,433,601, 4,508,002, and 4,682,526 to Hall, et al.

In addition, some keyboard musical instruments provide for the automatic sharpening or flatting of a note on the white keys in response to a signal indicating that a scale is to be played in a key other than "C". An example of such an instrument is known in U.S. Pat. No. 4,513,650 to Nagaska, et al.

While these prior art schemes and devices have been successful and have performed their intended functions, there still remains a need for improvement.

BRIEF DESCRIPTION OF THE INVENTION

The present invention includes a set of force sensitive transducers, arranged, for example as a keyboard. The keyboard is electronically scanned and the identity of the key or keys being depressed, along with information relating to the velocity of that key depression, are snored. Stored tables in memory convert that information to MIDI standard information relating to pitch and velocity for transmission to MIDI compatible tone generators or to MIDI messages for any MIDI event. The tables may be standard tables employing chord voicing information, individual note information, or other information relating to the MIDI events to be implemented. The tables switch in real time at a speed sufficient to seem transparent to the user, thus allowing dynamic reconfiguration of the keyboard during the performance of the musical composition. In a presently-preferred embodiment, the tables are arranged such that during the interval of time in which a particular chord is being played, the depression of any key will result in the generation of a "correct" note in that chord or a "correct" note in a scale which is compatible with that chord. It is thus impossible for the musician to strike a wrong note. In addition, the keyboard may be operated at 100% efficiency because the keys may be defined such that they are all utilizable at any time during the performance of the musical composition. This affords the musician the widest possible choice of correct notes and chords at any point in the performance.

FIGS. *5a–f* are a flow diagram for the mapping software useful for the present invention.

FIGS. *6a–j* illustrate screen contents when using a computer for editing tables.

DETAILED DESCRIPTION OF A PREFERRED EMBODIMENT

In a presently preferred embodiment, the MIDI standard (Musical Instrument Digital Interface) is utilized to define which note is to be played and the volume (velocity) at which that note is to be played. As those of ordinary skill in the art will appreciate, the MIDI standard allows for both note pitch and note velocity (volume) information to be transmitted to a tone generator. The MIDI standard is well known and the MIDI Specification 1.0 is hereby incorporated by reference.

Figure 1:
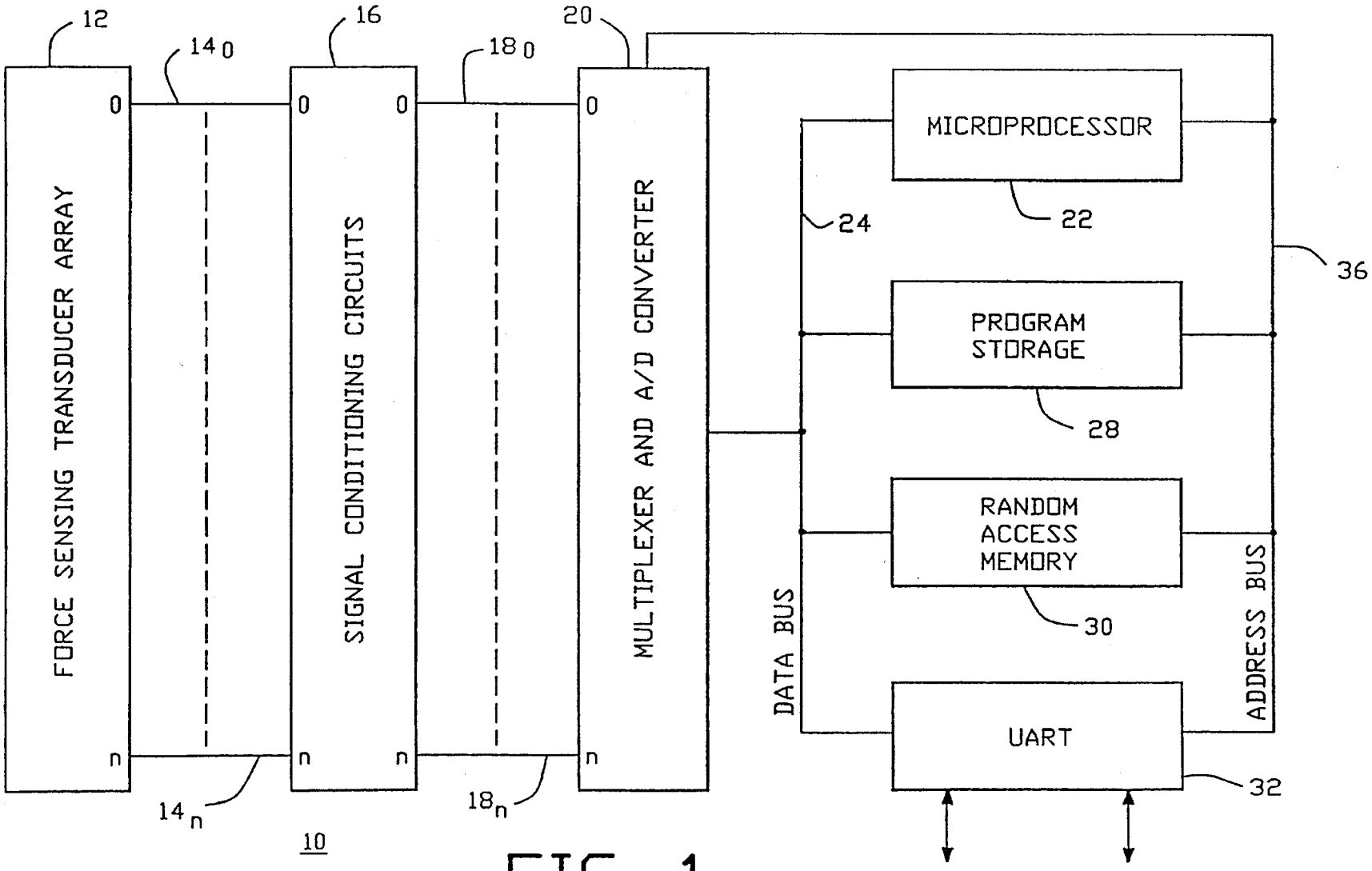
FIG. 1 is a block diagram of a presently-preferred embodiment of the invention.

Referring first to FIG. 1, a block diagram of the musical instrument system 10 of the present invention, an array of input switching devices comprising force sensing transducers 12 is used as the interface between the musician and the instrument. In its most common form, force sensitive transducer array 12 may be configured as a keyboard, having the appearance of a keyboard of a conventional musical instrument, including both white keys and black keys. Other keyboard arrangements, such as that shown in FIG. 4, infra, may be used. Those of ordinary skill in the art will recognize that, in accordance with the present invention, the human interface may also be configured to resemble a guitar neck, a series of percussion pad inputs, or the like. For the purpose of simplicity, reference will be made herein to keys as if a keyboard is being discussed, but those of ordinary skill will realize that no limitation is intended by such usage.

Presently preferred force sensing transducers for the present invention are force sensing resistors such as those manufactured by Interlink Electronics of Santa Barbara, Calif. Those of ordinary skill in the art will recognize, however, what other input switching devices may be used, such as those commonly found on presently available electronic keyboard instruments and the like.

In the block diagram of FIG. 1, there are n+1 force sensing resistors, having outputs on lines $\mathbf{14}_0$ through $\mathbf{14}_n$. These output lines $\mathbf{14}_0$–$\mathbf{14}_n$ are connected to signal conditioning circuits 16. The function of signal conditioning circuits 16 is to convert the output of each force sensing resistor in the array 12 to a DC voltage signal having a voltage range which can be utilized by the rest of the system. The outputs from the signal conditioning circuits, shown on lines $\mathbf{18}_0$–$\mathbf{18}_n$, are connected to multiplexer and analog to digital (A/D) converter circuit 20. The function of multiplexer and A/D circuit 20 is to select one of lines $\mathbf{18}_0$ through $\mathbf{18}_n$ and connect it to an analog to digital converter which then converts the voltage appearing on that line to a multi-bit digital representation, as is well known in the art.

The operations of system 10 are controlled via microprocessor 22, which is connected to a data bus 24 and an address bus 26. The multi-bit digital output of the A/D converter portion of multiplexer and A/D converter 20 is connected to data bus 24. Address bus 26 is connected to the multiplexer and A/D converter circuit 20 in order to control the addressing of the multiplexer.

As is common in microprocessor-controlled circuits, a program for controlling the operation of microprocessor 22 is stored in program storage 28, which may be a read-only memory (ROM), a programmable read-only memory (PROM), or other similar means known in the art, such as EPROMs, EEPROMs, etc. Program storage 28 is connected to data bus 24 and address bus 26. In addition, random access memory 30 is also connected to data bus 24 and address bus 26.

Universal Asynchronous Receiver Transmitter (UART) 32 is also connected to data bus 24 and address bus 26. As is well understood by those of ordinary skill in the art, UART 32 is utilized to interface between the system 10 of the present invention and a series of one or more tone generators, which produce the musical sounds in response to the musician's manipulations of the keyboard containing the force sensing resistors.

A MIDI system exclusive message may be utilized via the UART for editing purposes. This message may originate from an external editing source, such as a computer, disclosed later herein, or a sequencer performing a systems exclusive data drive as is understood by those skilled in the art. MIDI patch change information is also communicated through this port.

Figure 2:
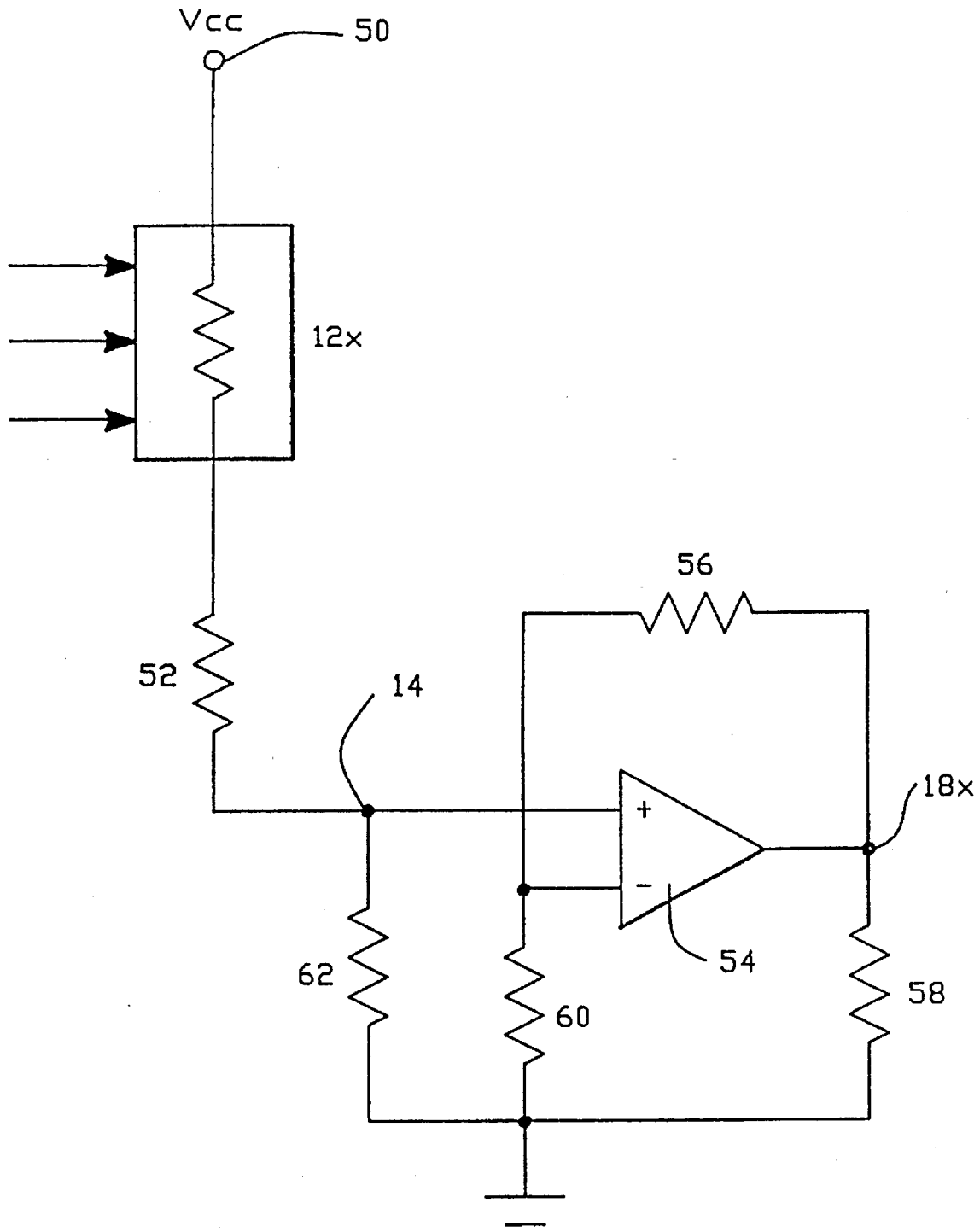
FIG. 2 is a schematic drawing of the data acquisition apparatus of a presently-preferred embodiment of the invention, including the force sensing resistors and signal conditioning circuitry.

Referring now to FIG. 2, a force sensing resistor $\mathbf{12}_x$ is shown connected at one end to a source of positive voltage 50. A limiting resistor 52 is connected to the other end of the force sensing resistor 12 and at its other end to the non-inverting input of amplifier 54. Resistor 56 is shown connected between the output of operational amplifier 54 and its inverting input. Resistor 58 is connected between the output of operational amplifier 54 and ground. Resistor 60 is connected between the inverting input of amplifier 54 and ground. Resistor 62 is connected between the non-inverting input of operational amplifier 54 and ground. The node comprising the bottom end of limiting resistor 52 and the non-inverting input of operational amplifier 54 is one of the lines 14 shown in FIG. 1. The output of operational amplifier 54 is one of the lines 18 shown in FIG. 1. In a presently preferred embodiment, amplifier 54 may be an LM324 operational amplifier and resistors 52, 56, 58, 60 and 62 may be 10 kOhms.

The output of the circuit of FIG. 2 is a DC voltage between approximately 0 volts and 4 volts with a power supply voltage of 5 volts. When no pressure is applied to the force sensing resistor, its resistance may be greater than approximately 2 megohms. When a reasonable finger pressure is applied to force sensing resistor $\mathbf{12}_x$, its resistance will decrease to a value in the neighborhood of 5 kOhms, and a fingertip impulse to the force-sensing resistor can drive its resistance down to as low as 2 to 3 kOhms or lower.

Those of ordinary skill in the art will recognize that as the number of keys increases, the total scan time necessary to read and digitize the outputs of operational amplifiers 54 will increase. At some large number of keys the time will become large enough to affect performance and require higher speed performance components. To avoid degraded performance and to avoid the need to use higher speed performance hardware, it is presently preferred to modularize the hardware into blocks handling sixteen keys. These modules may be interfaced to one another to configure systems of larger size incrementally by groups of sixteen keys.

In such an embodiment, an ADC0816 sixteen channel multiplexer and 8-bit A/D converter, manufactured by National semiconductor of Santa Clara, Calif. may be utilized. An 8032 microprocessor, manufactured by Intel Corporation of Santa Clara, Calif., is satisfactory to drive a modular system handling sixteen keys. In such a modular embodiment, a program storage capacity of 32k is sufficient. The tables necessary for operation of the present invention may also be stored in ROM. A 32k dynamic random access memory is satisfactory for use in this preferred modular embodiment. Those of ordinary skill in the art will readily recognize that the modularity disclosed herein, while presently preferred, is not to be taken as in any way limiting the scope of the present invention.

The hardware of FIGS. 1 and 2 is driven by a software program. In a presently preferred embodiment the software includes one main loop and two interrupt-driven tasks.

Figure 3A:
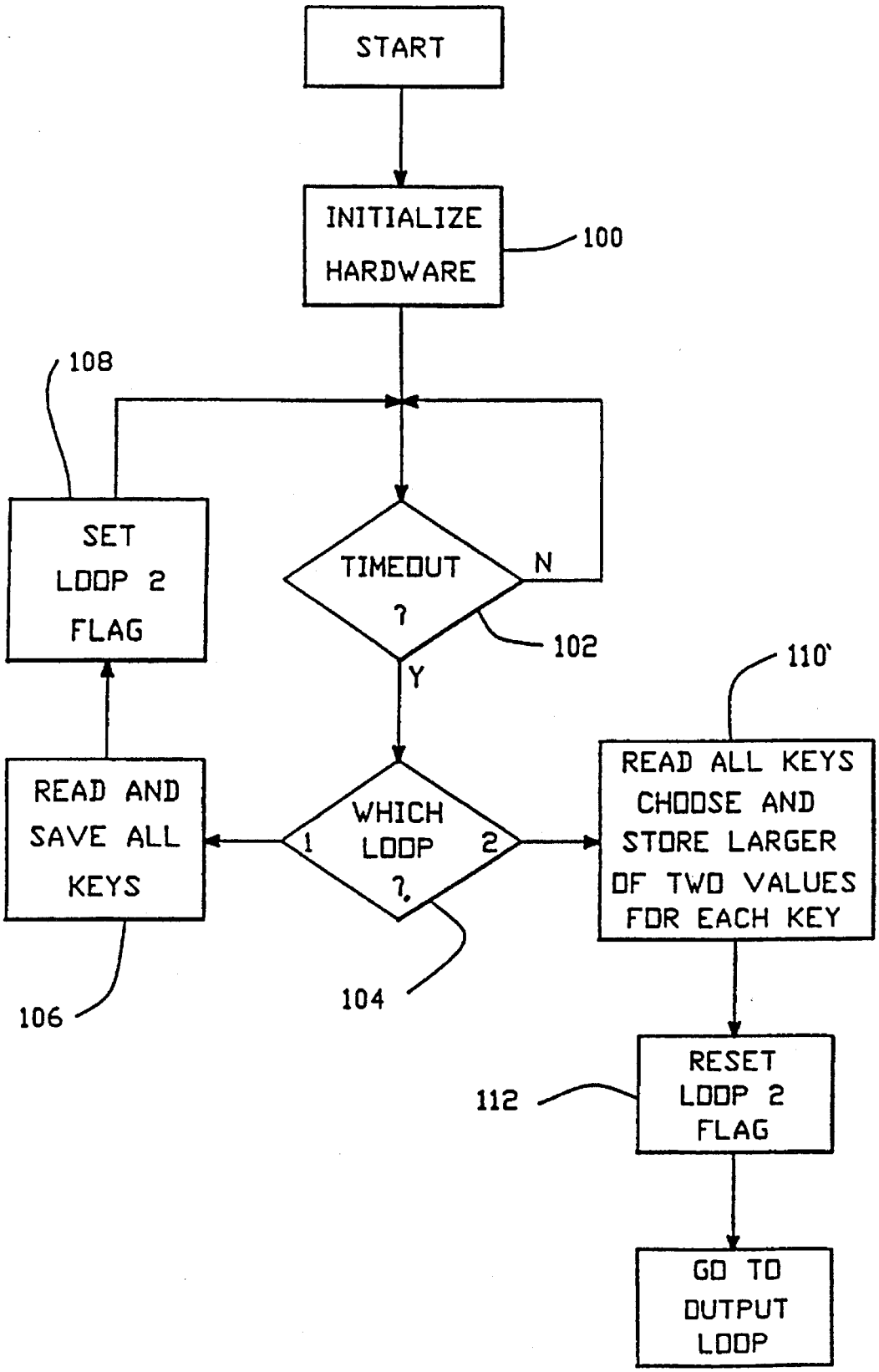
FIG. 3A is a flow diagram for the main loop executed by the software for the present invention.

Referring now to FIG. 3*a*, the main loop of a presently-preferred software routine for use with the present invention is shown. First, at step 100, the hardware of the system is initialized and all flags are reset. The initialization process includes the scanning of all of the force sensing resistors for the purpose of determining a noise margin. The output of the A/D converter representing the output from each force sensing resistor circuit is stored and examined and a threshold, higher than the highest voltage reading, is set.

After hardware initialization, the software enters the main loop which reads the output of a timer at step 102. When the time out value has been reached the program determines which of two loops it is in at step 104. There are two loops because, in a presently-preferred embodiment, the DC voltage output of each force sensing transducer driven operational amplifier 54 corresponding to a key on the keyboard is read twice. If it is determined at step 104 that the software is in the first loop, the DC voltage outputs of all of the operational amplifiers 54 are read and saved in memory at step 106. Next, at step 108, the loop 2 flag is set. The program then returns to step 102.

If, however, it has been determined that the software is in the second loop at step 104, the program again reads all of the DC voltages at the outputs of operational amplifiers at step 110. The DC voltage value read during execution of the second loop for each key on the keyboard is compared with the previously-stored DC voltage value for that key from the first loop, and the larger of the two values is selected. Next, at step 112, the loop 2 flag is reset. The software then proceeds to an output loop.

Figure 3B:
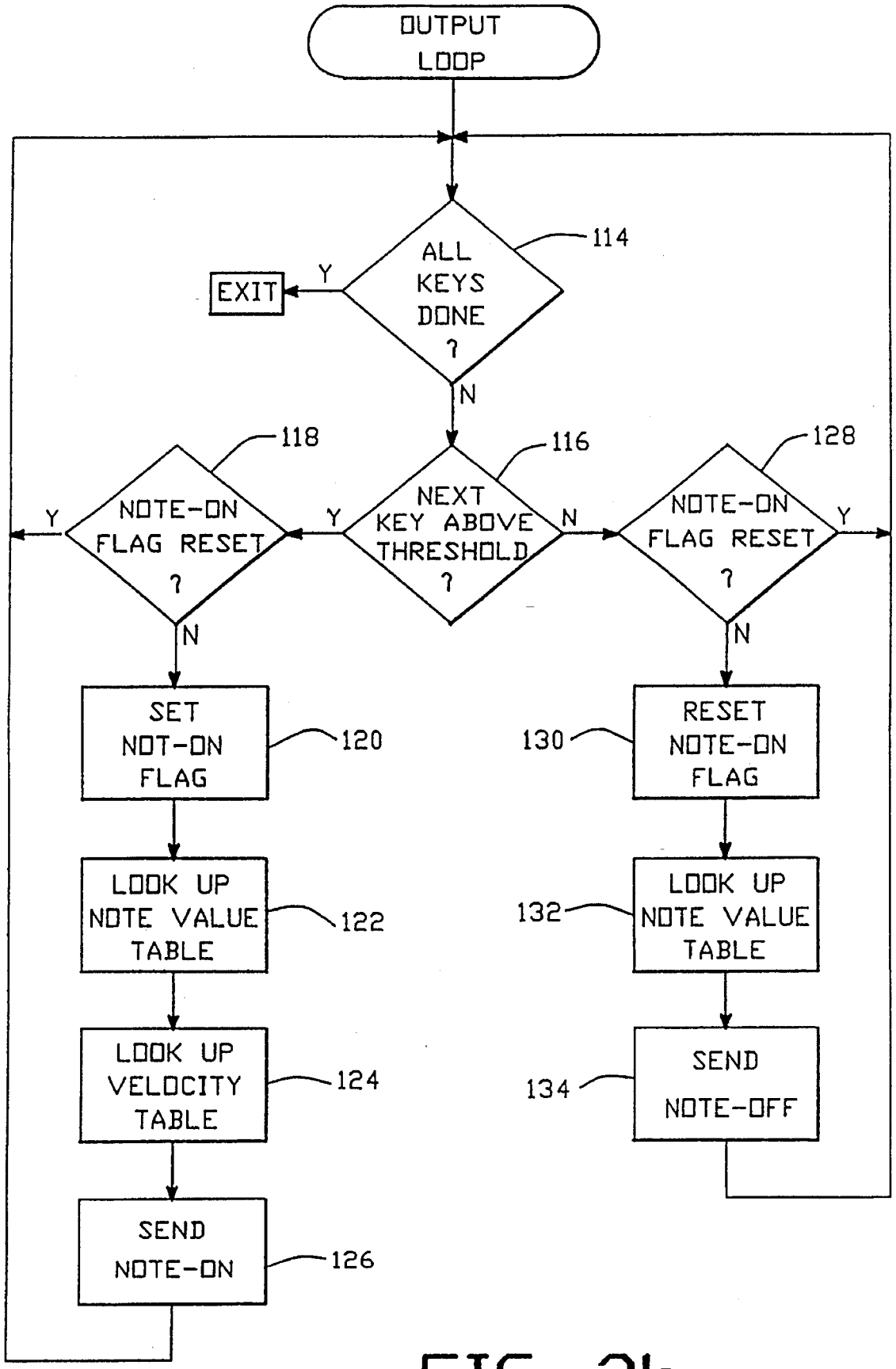
FIG. 3B is a flow diagram for the output loop executed by the software for the present invention.

The output loop of the presently-preferred embodiment is shown at FIG. 3*b*. First, at step 114, it is determined whether data from all keys on the keyboard have been processed. If so, the software exits from the output loop. If not, at step 116 it is determined whether the stored digitized DC voltage value for the next key on the keyboard is above the threshold determined during the initialization routine. If it is, the note-on flag for that particular key is read to see if it is set. If it is set, the program returns to step 114. If it has not been set, the note-on flag for that particular key is set at step 120. Next, at step 122 the software refers to a note value table to define the note. In the presently-preferred embodiment, the note's definition will be a MIDI code. Those of ordinary skill in the art will realize that this note-on signal may be designated for any MIDI channel.

The velocity information relating to the note is also determined by reference to a table, which converts the raw digitized DC voltage value associated with each key on the keyboard to a MIDI velocity code. Those of ordinary skill in the art will recognize that use of such a table allows for expansion, compression or other volume level manipulation. At step 124, an address derived from the raw digitized DC value is used to address a velocity table to obtain a MIDI velocity value. Next, at step 126, a MIDI note-on message is sent with the calculated velocity. The program then returns to step 114.

If, at step 116, it is determined that the DC voltage value corresponding to the key on the keyboard is below threshold, at step 128 it is determined whether the note-on flag for that particular key has been reset. If it has, the program returns to step 114. If it has not, at step 130 the note-on flag for that particular key is reset. Next, at step 132 the note value table is again consulted to determine the MIDI code for the note that has been assigned to the key being depressed. Next, at step 132, a MIDI note-off message is sent with velocity=0 and the program returns to step 114.

One of the features of the present invention which sets it apart from anything known in the prior art is the use of the tables which give the system the ability to assign any key to any note value or any other MIDI event. Table switching is performed in real time at a speed sufficient to render the process undetectable to the ear. The two primary types of tables are chord tables and scale tables.

Chord tables are normally accessed via a specified section of the keyboard (such as all black notes in a conventional keyboard.) These tables contain all possible notes within a given chord and may be assigned in any manner desired. For example, a C major chord consists of the three notes C,E, and G. In ascending pitch, the notes might be assigned to a particular key or group of keys in any, including, but not limited to the following: E-G-C, E-C-G, C-E-G, C-E-G-C, etc., with the ability to assign various octaves and instrument voices.

Scale tables contain all notes within a given scale and are likewise accessed by a specified section of the keyboard. Chord tables and scale tables may be switched independently of one another either in real time by the user or via predetermined computer control such as via a sequencer or the like.

In one embodiment of the present invention, chord and scale information may be stored along with pre-recorded music on musical media such as a CD disk and may be sent to the system of the present invention via a MIDI interface so that a musician can "play along" with prerecorded music. Since the chord change and any scale change timing is synchronously provided by the pre-recorded media, the musician has creative input but does not have the option of playing an incorrect chord or note.

In this embodiment, the code necessary to implement chord changes requires only a fraction of the memory necessary to store melody and chord notes on a CD for playing along, thus making such an embodiment a practical reality. For instance, a typical popular music selection would require up to 500K bytes of information to reproduce the parts contained on the recording. A 10 song album could require 5M bytes or more of memory, and would not afford creative input by the listener. On the other hand, with the present invention, only one MIDI message per chord change or scale change is required. Using the present invention, chord changes for an entire album could reside in less than 100K bytes of memory. This not only reduces cost to a practical level, but at the same time allows the listener to provide creative accompaniment to the recorded music. As the CD plays, the chord changes appear as MIDI patch changes at the moment the CD accesses the appropriate address during its play cycle.

The number of tables which may be associated with the system of the present invention is limited only by the size of the memory which is utilized with the system. For instance, with a memory size of 64K, scale tables and chord tables for sixteen of the most common chords for each root note for 128 different keyboard keys can be provided.

By the arrangement of and switching of the tables, the user is presented with an incredibly flexible musical instrument that contains all of the correct musical choices at any given point in time, but only those correct choices. Since only correct choices are presented, the musician is freed from the complex and sometimes tedious task of performing the mathematical calculations necessary to execute correct chord, melody and harmony structures.

Figure 4:
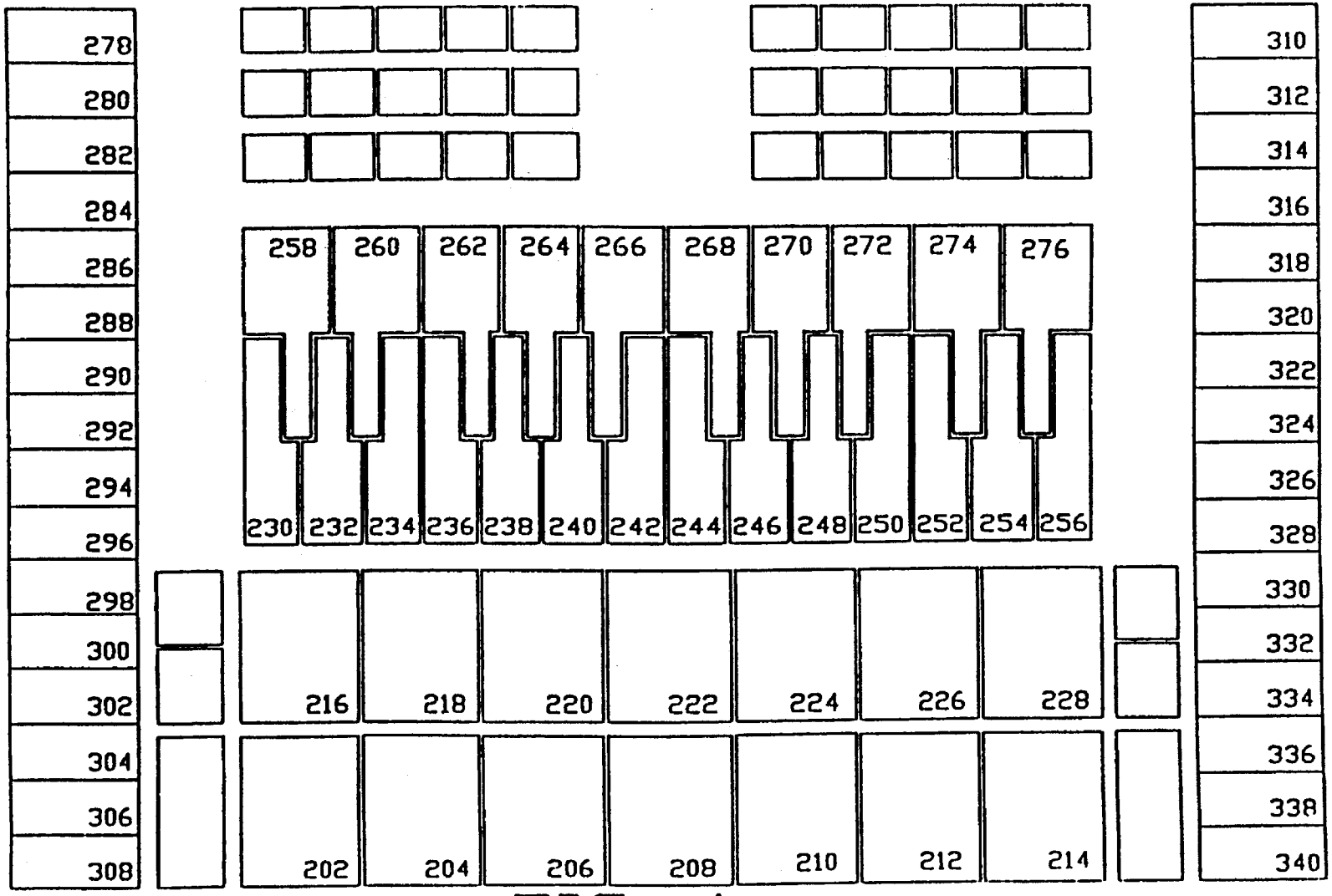
FIG. 4 is a presently-preferred embodiment of a layout of a force sensing resistor keyboard for use in the present invention.

Referring now to FIG. 4, a presently-preferred layout for a keyboard for use as part of the present invention is shown. A first group of two sets of seven function keys, indicated by even reference numerals 202–228, preferably relate to chord tables. Depressing any one of keys 202–228 will result in the generation of MIDI codes representing a component note of a desired musical chord.

The section of keys just above keys 202–228 is arranged much like two octaves of a conventional keyboard. Keys bearing even reference numerals 230–256 are the white keys of the keyboard and keys bearing even reference numerals 258–276 are the black keys of the keyboard. Note that the particular layout permits playing black keys only by running a finger across the keyboard, since white keys do not extend all of the way between black keys.

The white keys 230–256 are assigned to individual notes from scale tables. However, unlike a conventional keyboard, keys 230–256 are all utilized in the playing of each scale. If the scale is arranged so that key 230 is always the root note, the keyboard may be arranged such that key 232 is always the second, key 234 is always the third, key 236 is always the fourth, key 238 is always the fifth, key 240 is always the sixth, key 242 is always the seventh, key 244 is octave and so on.

Those of ordinary skill in the art will recognize that this arrangement results in a 100% efficient keyboard in that all keys are proper notes and are used in any scale. Furthermore, the key/note assignments may be made such that the root note always resides at the memory location corresponding to key 230 so that playing a scale, major or minor, in any key is as simple as playing a C major scale on a conventional keyboard. This arrangement frees the musician from having to count notes and intervals and memorize musical keys and scales which require the use of the black keys on a conventional keyboard to implement sharps and flats. When compared with a conventional keyboard which has an efficiency of approximately from 25% to 60% from three note chords to a seven note scale, and which requires the musician to be ever mindful of flatted intervals and other peculiarities of certain musical chords, keys and scales, the power of and simplicity of use of the musical instrument of the present invention is readily discernible.

As examples of possible note/key assignments, Table 1 shows the note assignments to keys 230–256 for the C major, C♯ minor, D♯ major, and F minor scales respectively.

TABLE 1

| | C Major | C# Minor | D# Major | F Minor |
|---|---|---|---|---|
| Key 230 | C | C# | D# | F |
| Key 232 | D | D# | F | G |
| Key 234 | E | E | G | G# |
| Key 236 | F | F# | G# | A# |
| Key 238 | G | G# | A# | C |
| Key 240 | A | A# | C | D |
| Key 242 | B | B | D | D# |
| Key 244 | C | C# | D# | F |
| Key 246 | D | D# | F | G |
| Key 248 | E | E | G | G# |
| Key 250 | F | F# | G# | A# |
| Key 252 | G | G# | A# | C |
| Key 254 | A | A# | C | D |
| Key 256 | B | B | D | D# |

From the examples given in Table 1, those of ordinary skill in the art will easily configure the key/note map for any musical scale. In systems employing tone generators which are capable of outputting non-standard intervals, such as are found in certain Arabic and Oriental musical structures, key/note maps to implement these otherwise difficult musical systems are easily developed. It will additionally be noted from Table 1 that the playing of a scale in a different key is easily accomplished on the same keys which would produce the scale of C major on a conventional keyboard, thus illustrating the elimination of the need to constantly calculate sharps and flats when in keys other than C major.

The black keys, even reference numerals 258–276 may be configured as the notes which are components of selected chords. For example, Table 2 note assignments to keys 258–276 for a C major and D♯ minor chord respectively.

TABLE 2

| | C Major | D# Minor |
|---|---|---|
| Key 258 | C | D# |
| Key 260 | E | F# |
| Key 262 | G | A# |
| Key 264 | C | D# |
| Key 266 | E | F# |
| Key 268 | G | A# |
| Key 270 | C | D# |
| Key 272 | E | F# |
| Key 274 | G | A# |
| Key 276 | C | D# |

Since the two sets of seven horizontal keys, even reference numerals 202–228, are also assigned to chord component notes, MIDI note-on messages from keys 258–276 may be sent on a different MIDI channel to drive a voice different from that associated with keys 202–228.

Two sets of 16 vertical keys, even reference numerals 278–308 and even reference numerals 310–340 respectively may be used for numerous functions. In a presently-preferred embodiment, keys with reference numerals 278–308 are used to cause MIDI program commands which will transform the rest of the unit to an entire window of corresponding scale and chord information and may also sound a chord if desired. Keys bearing reference numerals 310–340 may be configured to be a scale. Since white keys 230–256 are already configured as a scale, the two sets of scale keys can be used with different voices to create two scales of two different instruments. Those of ordinary skill in the art will readily recognize that the scales played on keys 230–256 and 310–340 respectively could even be different scales.

The two sets of three keys 342, 344 and 346, to the left of the double group of seven horizontal seven keys and 348, 350 and 352 to the right of the double group of seven horizontal keys may be used as MIDI control signals as positive pitch bend, negative pitch bend, modulation, etc.

The two sets of 15 keys above keys 230–276 may be used for any MIDI function. In a presently-preferred embodiment they may be used for any of the computer controlled functions disclosed with respect to FIGS. 6*a–i* and in Appendix A hereto.

While the embodiment of FIG. 4 has been discussed in terms of specific key functions, those of ordinary skill in the art will readily recognize that any key may be assigned any MIDI function and that the embodiment of FIG. 4 is merely a practical illustrative and presently-preferred arrangement.

The set of 16 vertical keys shown at even reference numerals 278–308, may be configured to cause MIDI program commands which will change the chord configured on keys 202–228 and 258–276. Depressing these program change keys can optionally sound the chord which they select. In this manner, the musician may play a song and with one finger redefine the chord keys at the appropriate times so that the song may be played without the possibility of striking an incorrect note in a chord. Optionally one or more of these keys may also cause one or both banks of scale keys 230–256 and 310–340 to define a different scale if it is desired.

Another computer, either integral with the system of FIG. 1, or an external computer may be used as a mapping tool to manipulate other MIDI compatible musical instruments as well as the musical instrument of the present invention. One computer which has been found to be particularly suitable for use with the present invention is the Atari 1040 ST computer, which comes with a built-in MIDI interface. A program usable for such a computer to implement some of the functions of the present invention, along with its related documentation, is attached hereto as appendix A and is expressly incorporated herein by reference.

Figure 5A:
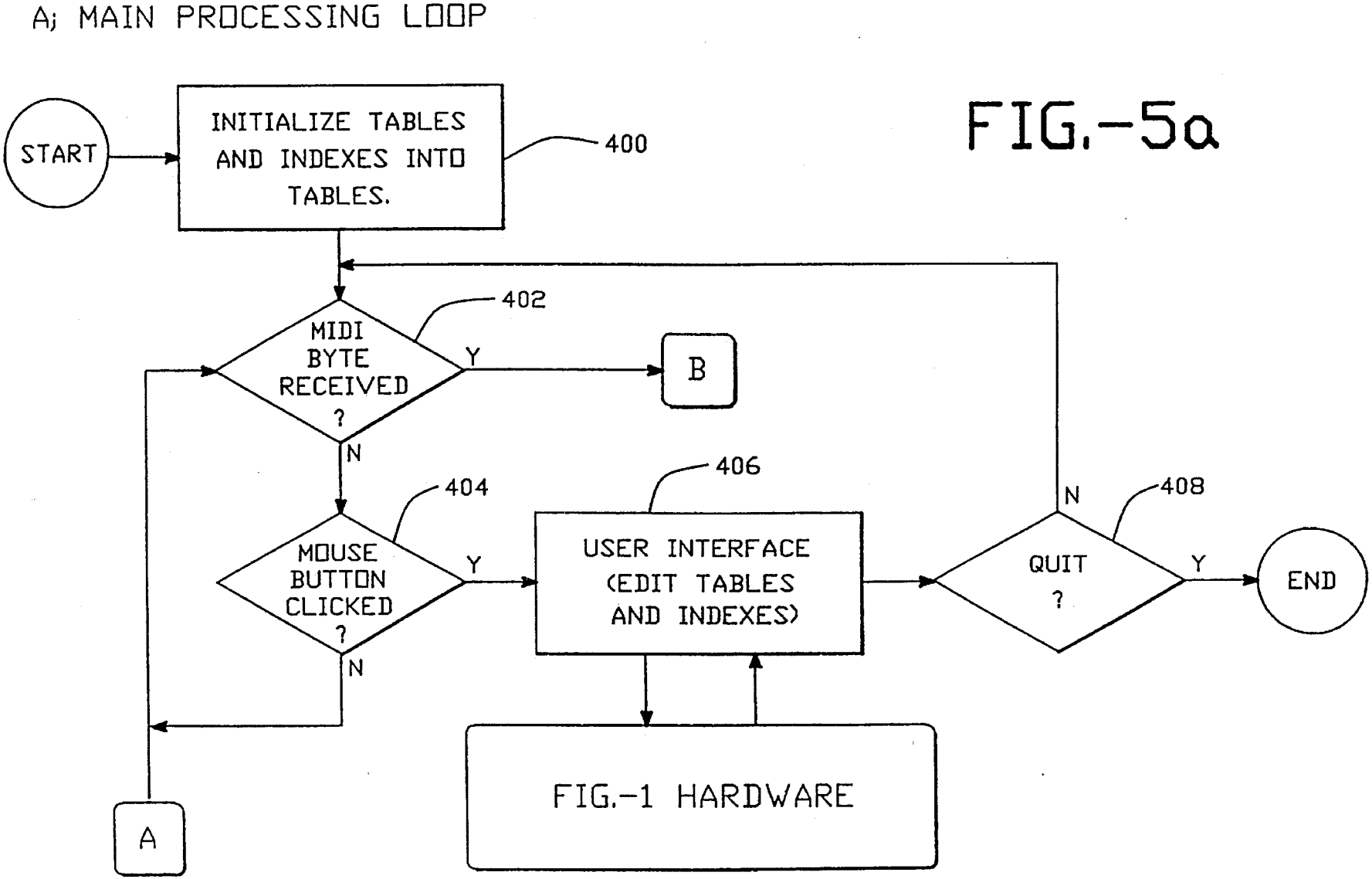

FIGS. 5*a–f* show the essential operation of the computer program disclosed in appendix A in block diagram form. Referring first to FIG. 5*a*, the main loop begins at step 400 where all the tables and indices are initialized as is well understood by those of ordinary skill in the art. Next, at step 402 it is determined whether a MIDI byte has been received. If a MIDI byte has been received, the program proceeds to the MIDI processing loop disclosed with respect to FIG. 5*b*. If not, at step 404 a determination is made whether one of the mouse buttons has been clicked. If not, the loop returns to step 402. If a mouse button has been clicked, the program proceeds to block 406 where the tables and indices are edited by user interface. After the user has edited the desired tables, a determination is made at step 408 whether it is desire to quit the program. If so, the program is ended and if not, it returns to step 402.

Figure 5B:
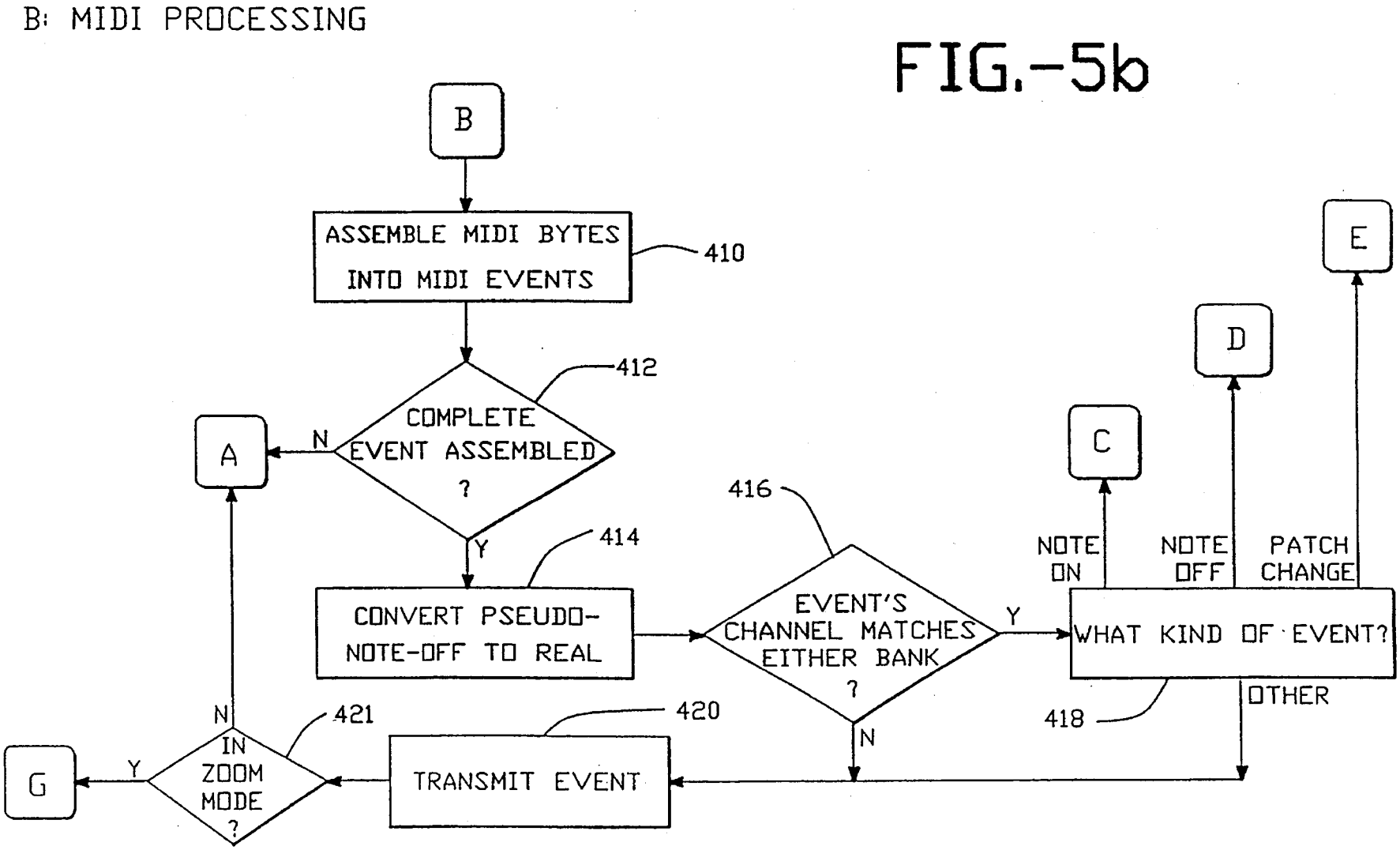

Referring now to FIG. 5*b*, the MIDI processing routine is disclosed. First, at step 410 the received MIDI bytes are assembled into MIDI events. Next, at step 412, it is determined whether a complete MIDI event has been assembled. If not, the program returns to the main processing loop. If, however, a complete MIDI event has been assembled, if the event is a note-off, at step 414 a psuedo note-off command is changed to a real note-off command. Then, a determination is made at step 416 whether the events channel matches either the upper or the lower bank. If not, at step 420 the event is transmitted to the other MIDI units in the system and then at step 421 a determination is made regarding whether the program is in zoom mode. If not, the program returns to the main processing loop. If so, the program returns to zoom processing.

If, at step 416 the events channel has matched one of the two banks, a determination of what kind of MIDI event has been assembled is made at step 418. If it is a note-on event, the program proceeds to note-on processing described with respect to FIG. 5*c*. If the event is a note-off event, the program proceeds to note-off processing described with respect to FIG. 5*d*. If the event is a patch change, the program proceeds to patch change processing described with respect to FIG. 5*e*.

Figure 5C:
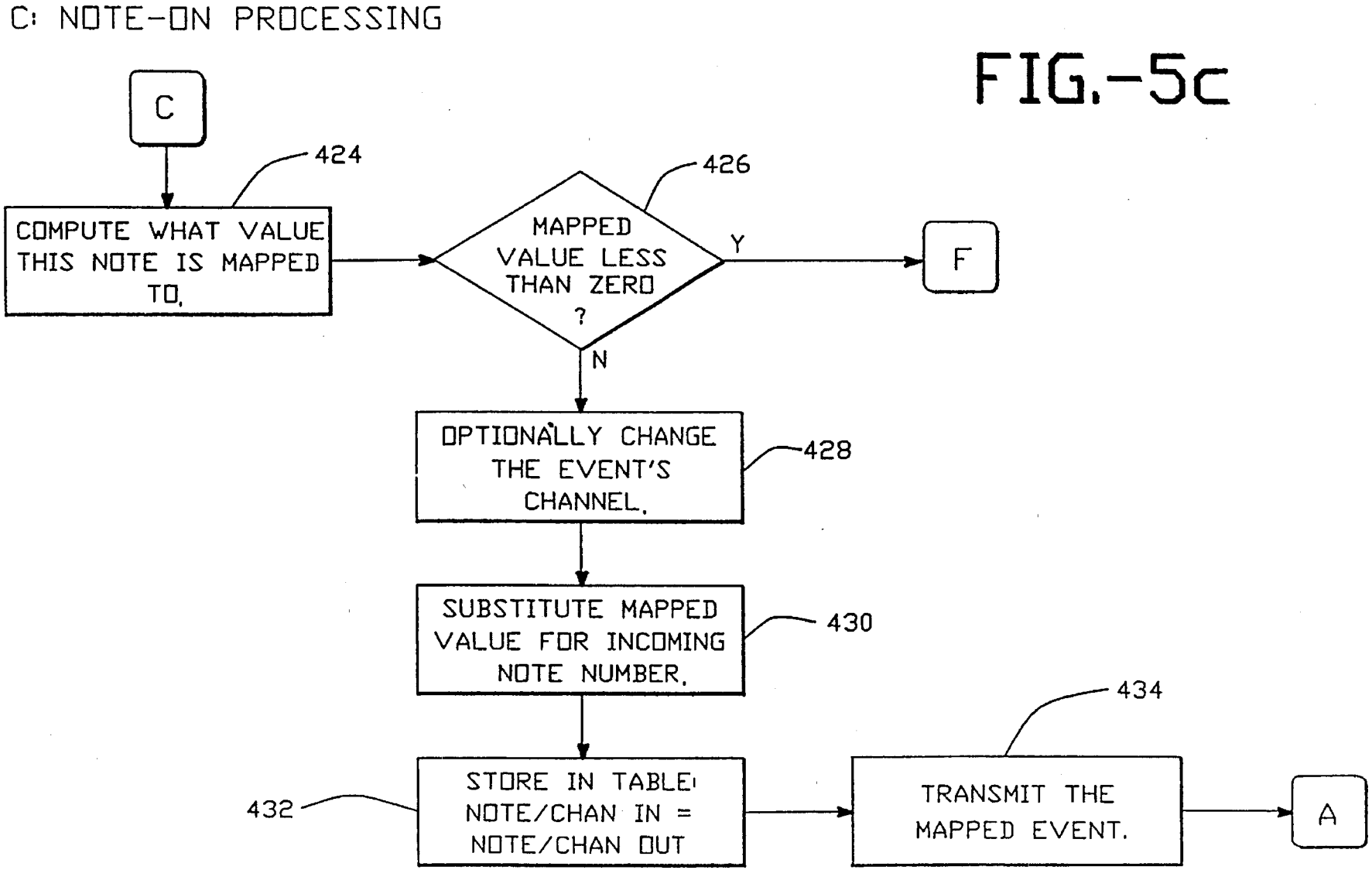

Referring now to FIG. 5*c*, the note-on processing routine begins at step 424 where the computation of what value this note is mapped into is made. At step 426, the value is examined to see if it is less than zero. If the note is mapped into a value of less than zero, it indicates zoom processing and the program proceeds to zoom processing as disclosed with respect to FIG. 5*f*.

If, however, the note has a mapped value of greater than zero at step 428 the events channel may optionally be changed if desired. At step 430 the mapped value for the incoming note number is substituted for the incoming note number. Next, at step 432 this map value is stored in a table which indicates the note and channel on which it came in and the note and channel on which it went out. This table is used later to identify the note to be turned off in the event of an intervening patch change. Next, at step 434 the mapped note-on event is transmitted over the MIDI channel.

Figure 5D:
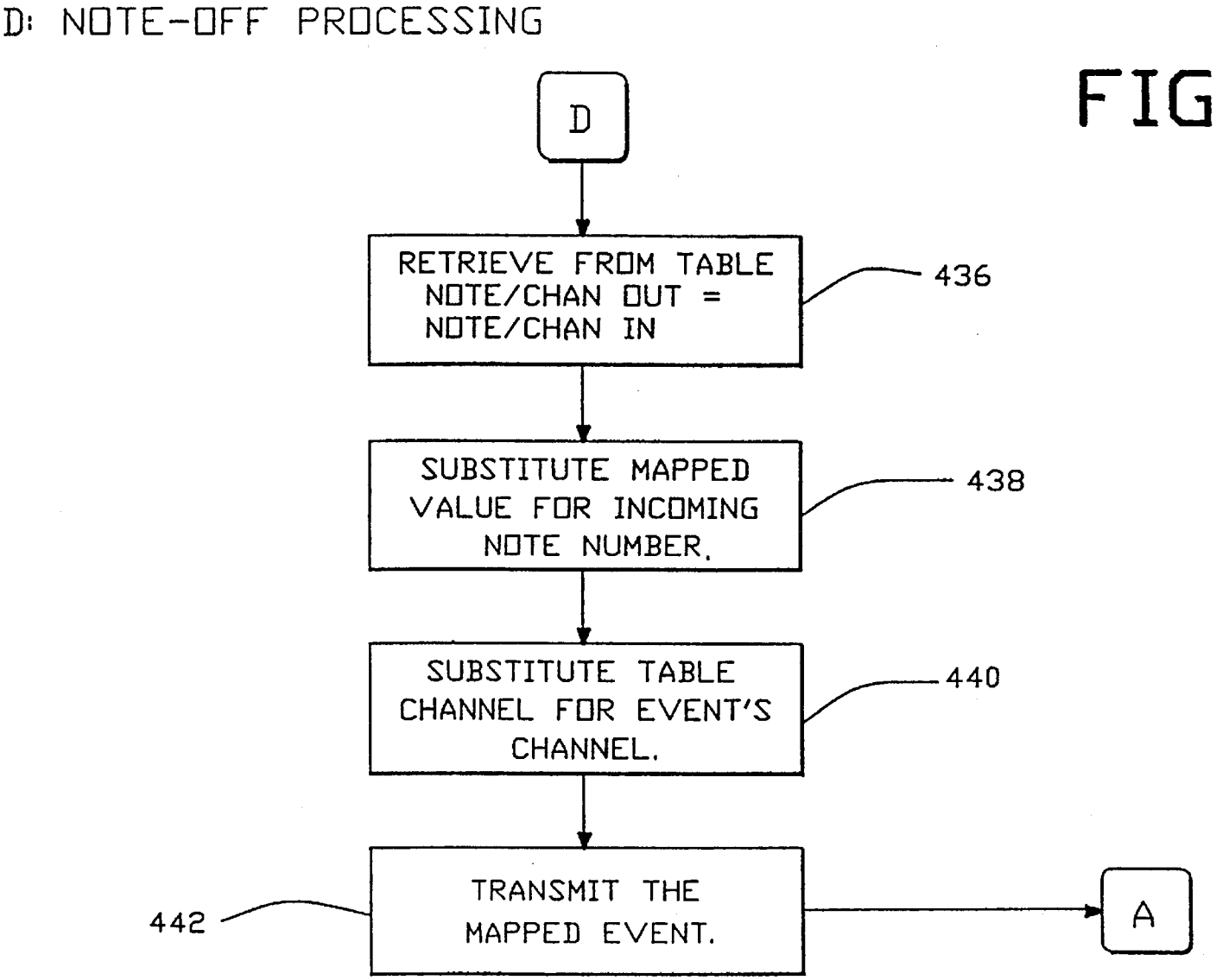

Referring to FIG. 5*d*, the note-off processing routine is disclosed. First, at step 436, the note and channel out and note and channel in information are retrieved from the table in which they were stored. Next, the mapped value of the stored note to be turned off is substituted for the incoming note number at step 438. At step 440, the table channel is substituted for the event's channel and at step 442 the mapped note-off event is transmitted.

Figure 5E:
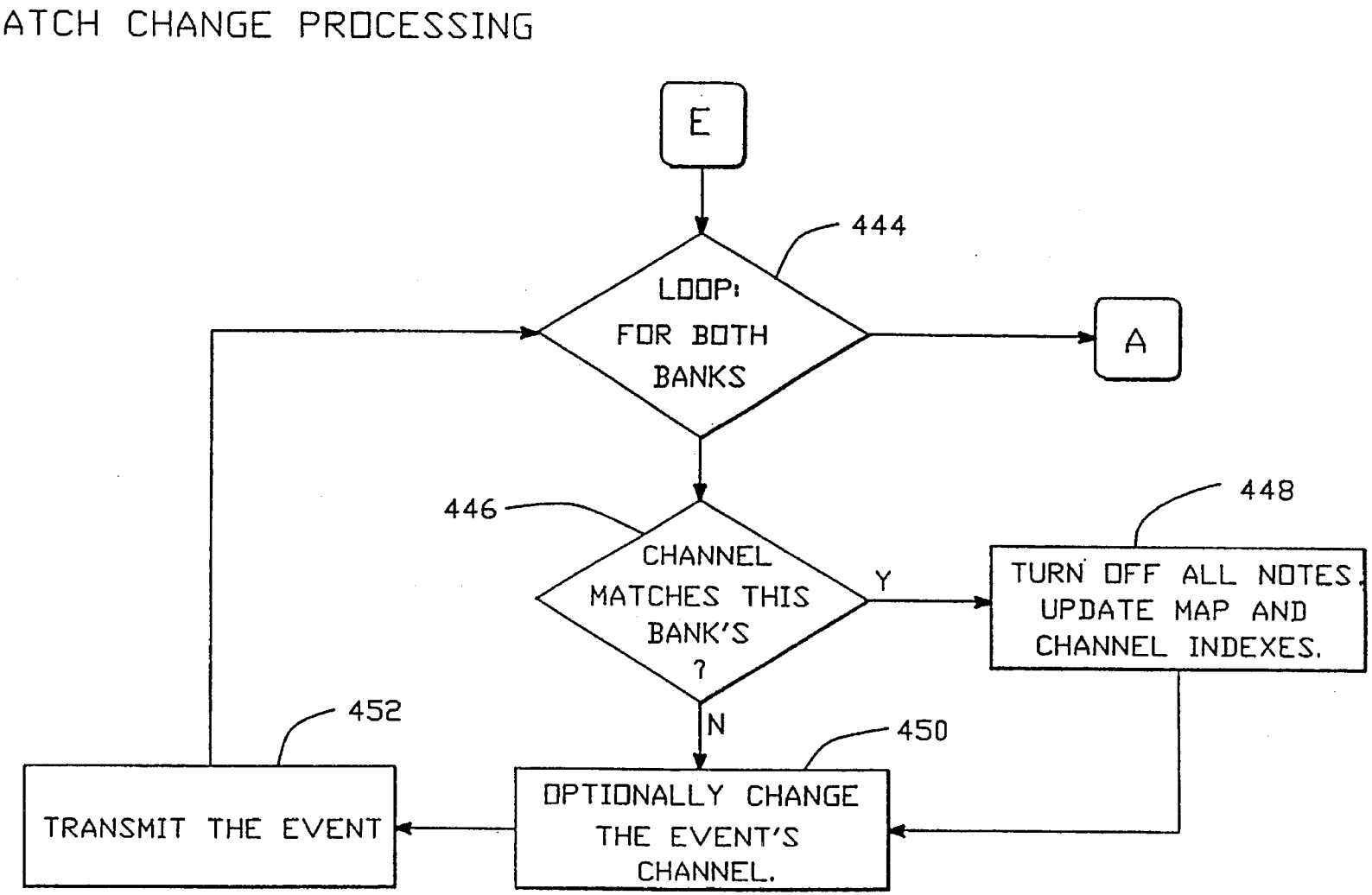

Referring to FIG. 5*e* the patch change processing routine is described. First, at step 444 it is determined to which bank the patch change refers. If there is no match, the program returns to the main processing loop. If there is a match, at step 446 it is determined whether the current bank number is the same as the current channel number. If it is, at step 448 the channel indices are updated. Step 450, is performed after step 446 if there is no match between the channel number and the bank number, and after step 448 if there has been a match. After step 450, the patch change MIDI event is transmitted at 452.

Figure 5F:
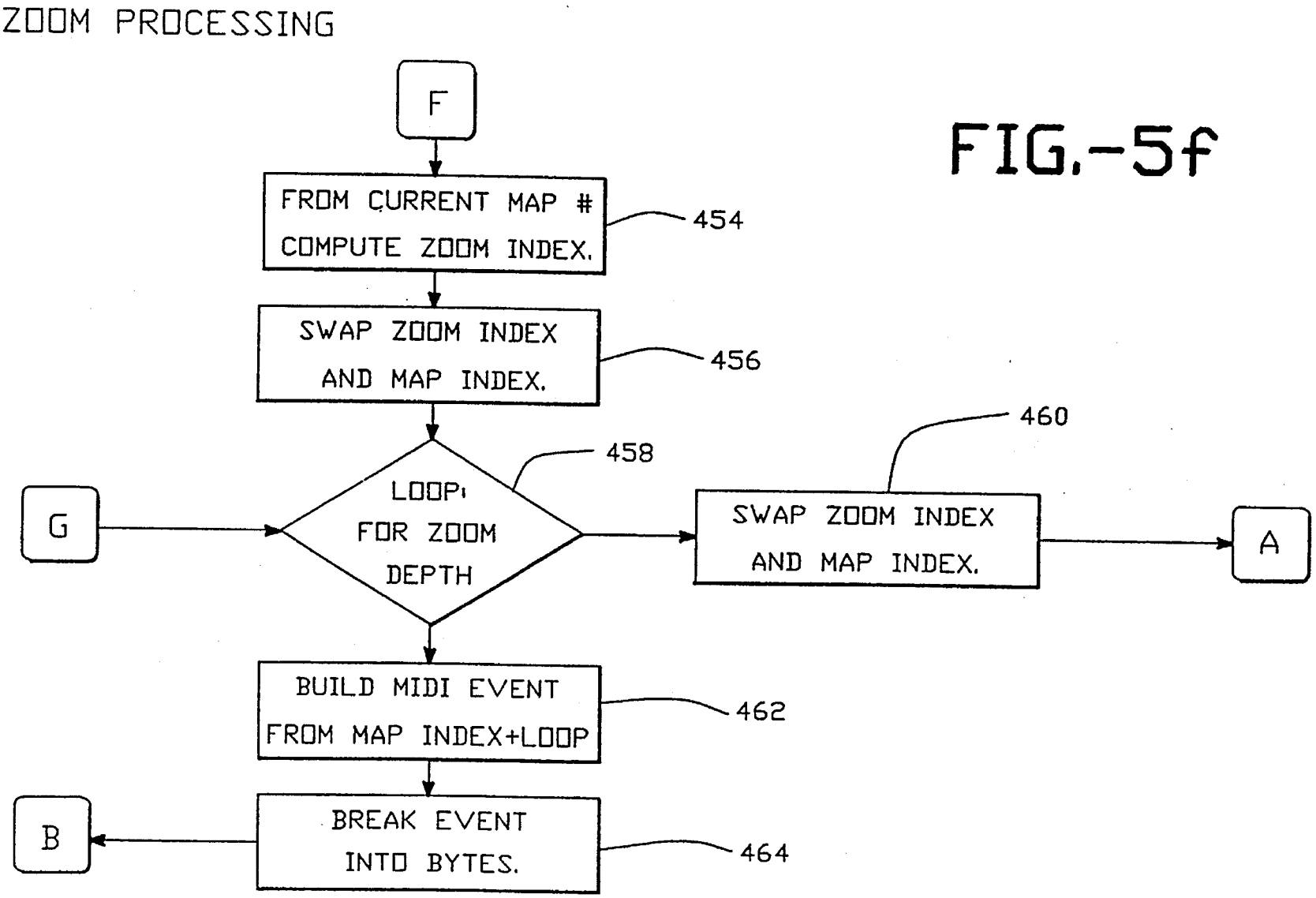
Figure 69:
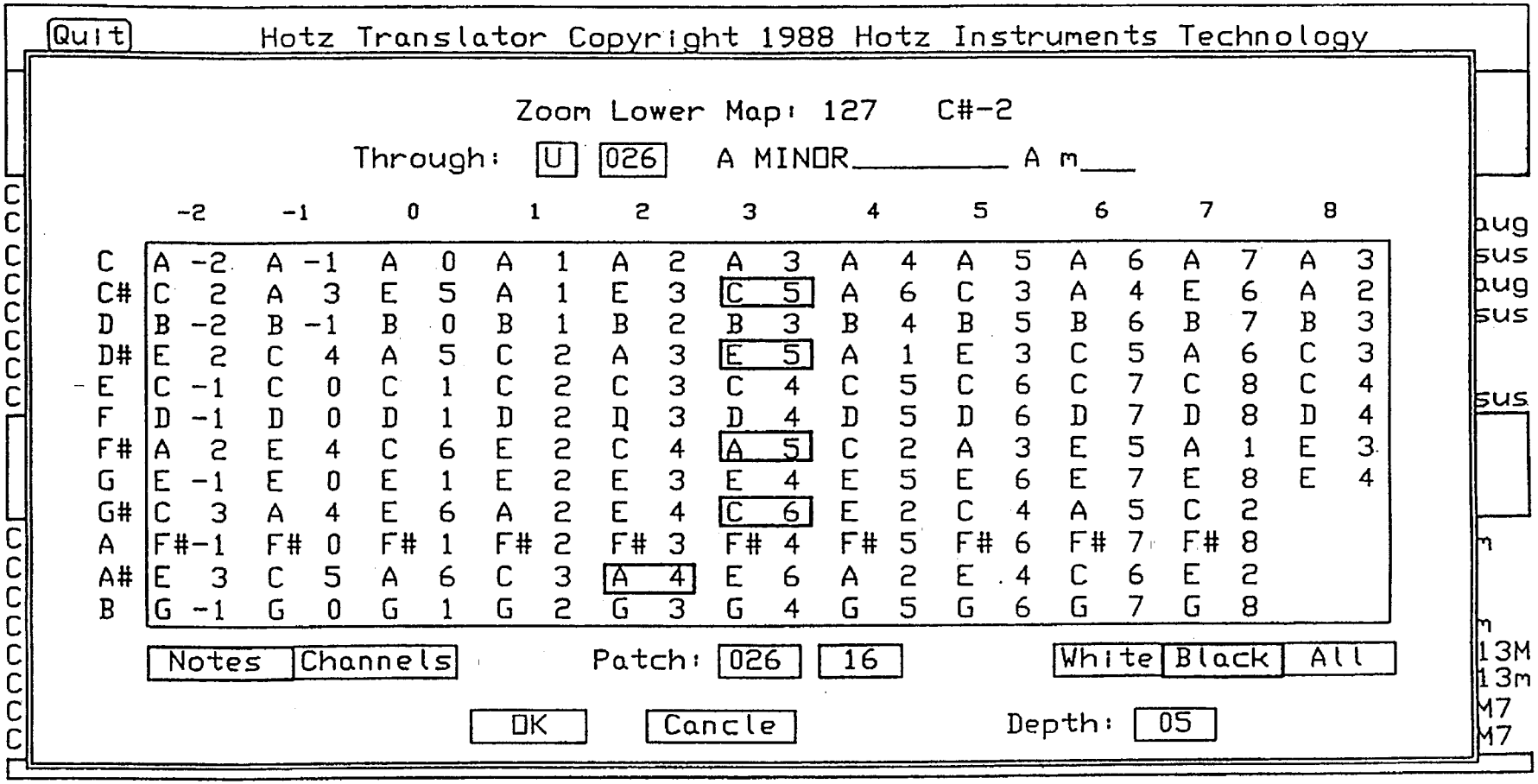

Referring now FIG. 5*f*, zoom processing begins at step 454 where a zoom index is computed from the current map number. Next, at step 456 the zoom index and the map index are swapped. Next, at step 458, a loop is performed relating to the zoom depth. If the count is not completed, at step 462 a MIDI event is built from the map index and the loop. Next, a step 464, the event is broken into bytes and the program proceeds to MIDI processing according to FIG. 5*b*. When the loop for zoom depth has been completed, the zoom index and map index are swapped in step 460 and the program returns to the main loop.

Since in the MIDI standard, there are 128 possible notes, the tables which are used with the present invention may be conveniently divided into 256 eight-bit bytes. The first set of 128 eight bit bytes define the 128 possible MIDI notes. The second 128 eight bit bytes define the MIDI channels over which the notes will be transmitted.

The tables are switched by a dynamic table allocation process. The tables are arranged in two banks of 128 tables each. Each table has 128 bytes. Each location in a table may hold a value of indicating one of 128 possible MIDI notes. A MIDI note which comes into the UART is directed to either the upper or the lower bank of tables depending on the channel number assigned to that incoming MIDI note. Which table in the bank is selected by the position of a mouse used in conjunction with the computer. Alternatively, the table can be selected by a MIDI patch change over a MIDI channel reserved for patch changes. The value of the incoming note (between zero and 127) determines the address to look at within the table. The contents of the table gives the note and channel number to be transmitted.

Note-off information, on the other hand, may not be related to the table from which the note-on information was obtained because of the possibility that a patch change will change the table to be referenced before that particular key on the keyboard is released. To avoid the problem of stuck notes, a second table, transparent to the user, is used to enter the note-on information. When the transducer circuitry senses that a key has been released, the system looks to this user transparent table to determine which note to turn off to avoid errors due to patch changes.

The previously described zoom function is a powerful function which allows the musician greatly enhanced flexibility when composing and playing compositions. It allows a single pad to play many notes, as in a chord, in place of a single note, and further optionally allows patch change information to be sent to co-ordinate chord changes among a plurality of MIDI instruments.

In order to better understand the zoom function, FIGS. 6*a*–H, show what the computer screen will show at various points in the zoom process.

In FIG. 6*a*, two tables are shown. The upper table is from the first bank of tables and the lower table is from the second bank of tables both previously described. In a presently-preferred embodiment, to conserve memory space, the upper and lower bank of tables each contain 16 tables which are zoomable. These tables are found as the last two columns of eight entries in each of the upper and lower banks. Each table of structures contains 128 structures. Each structure has six bytes. The first byte defines which of the 256 tables of both the upper and lower bank to address. The second byte contains a start address from zero to 127 within that table. The third byte contains two nibbles. The high nibble contains an all/white/black mask which allows either all keys, white keys only or black keys only to be selected. The low nibble decides how deep to zoom. The depth of the zoom is the number of notes in an upward direction from the start note. The fourth byte may contain an optional patch change which may be sent to other devices. The fifth byte contains information defining a channel for the patch change to sent over. Byte six is currently reserved for a function to be defined later. The zoom function is enabled as follows. Normally, the content of the note tables will be a note number. However, if the contents of the note table is minus one, a zoom table instead of a note table is referred to.

FIGS. *6a–j,* illustrate the use of a computer running the software disclosed in appendix A hereto to perform editing on the tables of the present invention. FIGS. *6a–j* are printouts showing the screen configurations of a computer at various steps in the editing process.

Referring first to FIG. *6a,* the screen shows an upper matrix of 16×8 table positions and a lower matrix of 16×8 table positions. Note that in the upper matrix, the chord B minor in the second row of the twelfth column appears in reverse video, having been selected by a mouse. Likewise, in the bottom of matrix, the chord D in the eighth row of the fifteenth column has been selected. In particular configuration, the sixteen zoomable tables have been located in the last two columns of both the upper and lower matrices. Thus, the selection of B minor in the upper matrix is not the selection of a zoomable table, but the selection of the D chord in the lower matrix is from a zoomable table.

Referring now to FIG. *6b,* the table for a B minor chord has been brought up. Note that in the far left-hand column, outside of the rectangle, a list of the 12 chromatic scale notes, beginning with C and ending with B, represents the key positions on a conventional keyboard corresponding to those notes. In the first row of the table outside of the rectangle, the numbers −2 through 8 signify the octaves spanning by MIDI. Within the rectangle, there are 128 entries, corresponding to the 128 possible keys of a keyboard addressed by the invention. Note that the screen contains three print styles, normal, bold, and reverse video as will be readily recognizable by those of ordinary skill in the art. In the fields below the rectangle, the indication "notes" has been selected by mouse, and thus appears in reverse video, indicating that this is a note table. It will be recognized that the notes which appear in bold representation on screen indeed represent the notes from an extended B minor scale. The notes appearing in normal video are unselected. It will be noted that seven notes in the third octave in the +3 octave column, seven notes in the +4 octave, and two notes in the +5 column have been displayed in reverse video. These 16 notes have been selected and assigned to keyboard keys by placing the mouse their locations and engaging the mouse button or by selection through MIDI input.

It should be understood that for the purposes of all of FIGS. *6a–j,* all 128 positions in the rectangle are always active and any one or group of these positions may be simultaneously selected for manipulation by the edit screen for any of the purposes described in the software documentation in Appendix A or may be selected for the purpose of downloading a group of 16 keyboard keys in a modular unit. This may be accomplished through a systems exclusive MIDI message as a single table, group of tables, or even by individual notes, channels or other MIDI events.

It will also be noted that in the field under the rectangle column, the indication "white" has been selected by the mouse and thus is shown in reverse video, indicating that white keys from the conventional keyboard notation in the first column have been selected. Thus, the 16 notes of the B minor scale shown will be played only when corresponding MIDI values, relating to white keys designated in the column to the left of the rectangle, are received in the appropriate octave designated by the note's position in the rectangle.

Referring now to FIG. *6c,* a third screen is shown, differing from the second screen in that the indication "black" has been selected by the mouse in the field under the rectangle. The 16 notes in the reverse video within the rectangular field have been selected by the mouse and correspond to the black key notations in the first column outside the rectangle. Those of ordinary skill in art will recognize that the selected notes are all contained within a B minor chord. This examples of white and black notes are not intended to indicate any limitation on the intermingling of white and black notes for any manipulation, as shown by the availability of the choice "all" in the "white/black/all" field under the rectangle.

Referring now to FIG. *6d,* the indication "channels" has been selected by the mouse and appears in reverse video, indicating that the portion of the tables dealing with the channels over which the notes are to be sent has been accessed. The screen shown in FIG. *6d* corresponds to the screen shown in FIG. *6c,* the reverse video images showing the channels over which the notes comprising the B minor chord shown in FIG. *6c* are to be sent. Those of ordinary skill in the art will recognize that any one of the 16 MIDI channels could be selected for any of these notes, thus allowing a single keyboard to play any chord or scale in one or more of several voices.

FIG. *6e* is included to show that any randomly chosen notes can be assigned to the selected black keys. Although not shown in FIG. *6e,* the same is true for the white keys, which may have assigned to them any random note or other MIDI event.

The zoom functioning of the present invention is shown with respect to FIGS. *6f–j.*

The lower matrix of FIG. *6a* had the D in the last row of column 15 selected. The screen shown in FIG. *6f* is brought up to edit the zoom function. The event which equals the position in the matrix i.e., C♯ in the −2 octave (C♯ −2), will cause anything selected in the zoom edit page shown in FIG. *6g* to be output, including patch change, note information or other MIDI events. It will be noted that the first column within the rectangle of the screen of FIG. *6f* contains chord information. In bold video the chords G, F, E minor, and C have been selected and are highlighted because the filters allowing zoom only are active, indicated by the indication "zoom" in reverse video. It should be understood that any one of the 128 positions within the rectangle on the screen of FIG. *6f* are zoomable. The A minor chord is shown in reverse video to indicate that it has been selected.

Referring now to FIG. *6g,* the reverse video indications of "notes" and "black" show that the notes of A minor chord indicated by the five reverse video notes in the rectangular field have been selected to be played when the MIDI values corresponding to the black key (C♯ −2 as selected in FIG. *6f*) has been received. This is indicated at the top of FIG. *6g.*

In FIG. *6g,* the A minor chord has been composed of the five notes shown in reverse video and will play. Anytime that the key indicated at the top of this edit screen is depressed, when its host edit page (here FIG. *6f*) has been selected, whatever is selected in the zoom rectangle will be output as indicated by the reverse video indication "black" in the field below the rectangle. The "depth" of "05" appearing in the field under the rectangle indicates how many notes are to be played in the chord and/or scale. This number is user selectable. The information "patch 026 16" in the field under the rectangle are user selectable and indicate that a MIDI patch change 026 will be sent out on channel 16. The MIDI patch numbers are shown in FIG. 6*h*. Comparing the position 026 in FIG. 6*h* to the corresponding position in FIG. 6*a* confirms that the patch relates to the A minor chord.

Figure 6B:
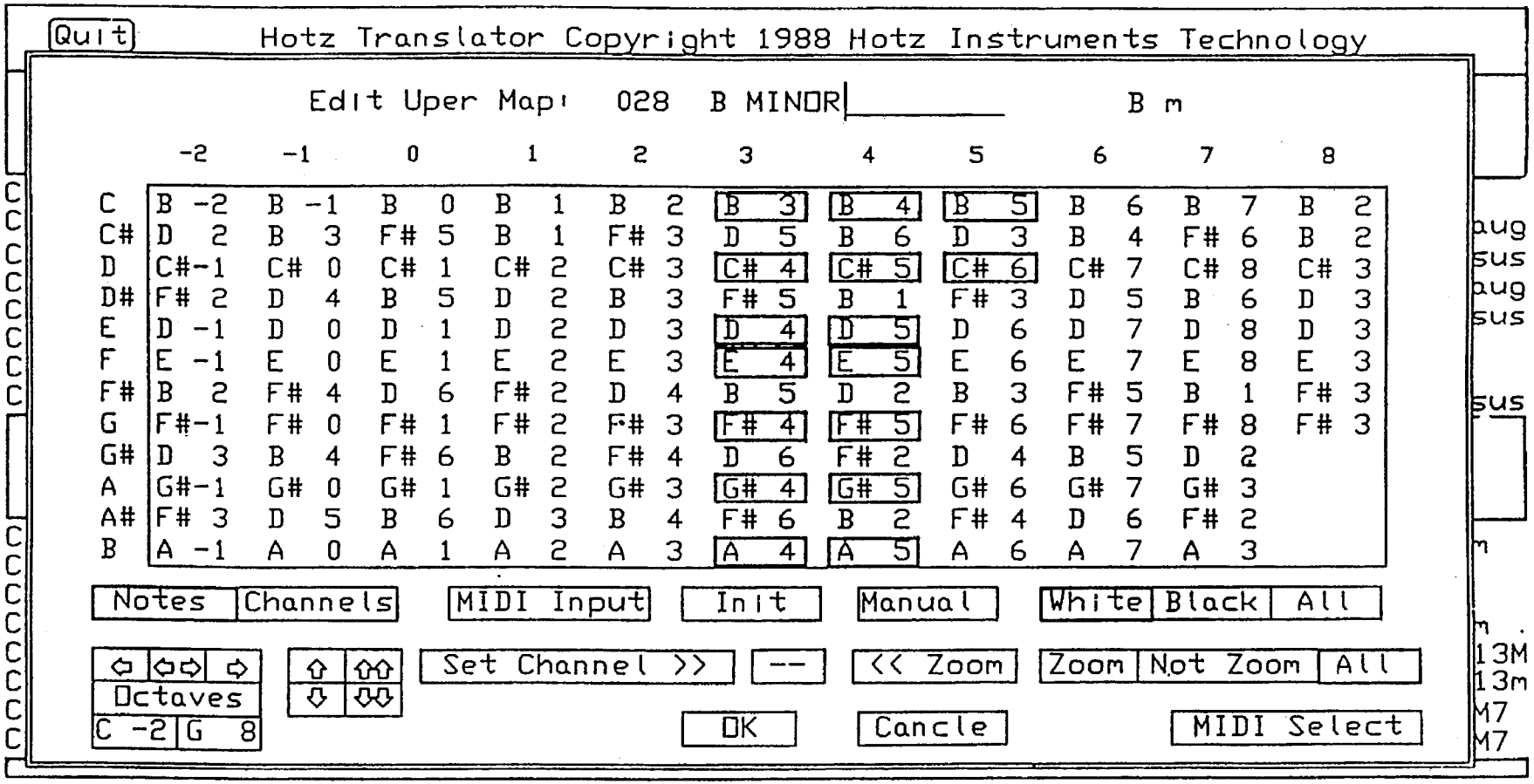
Figure 6C:
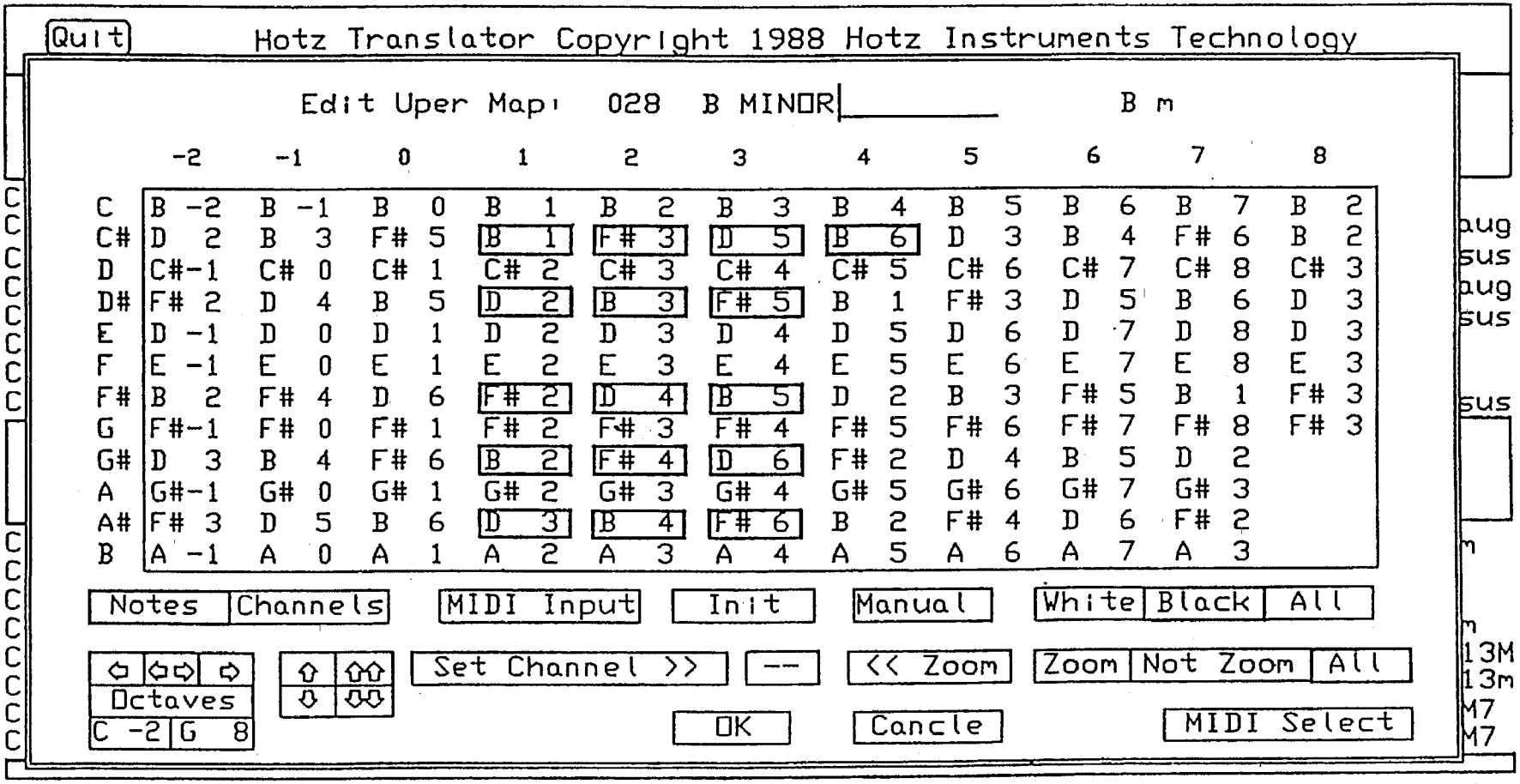
Figure 6D:
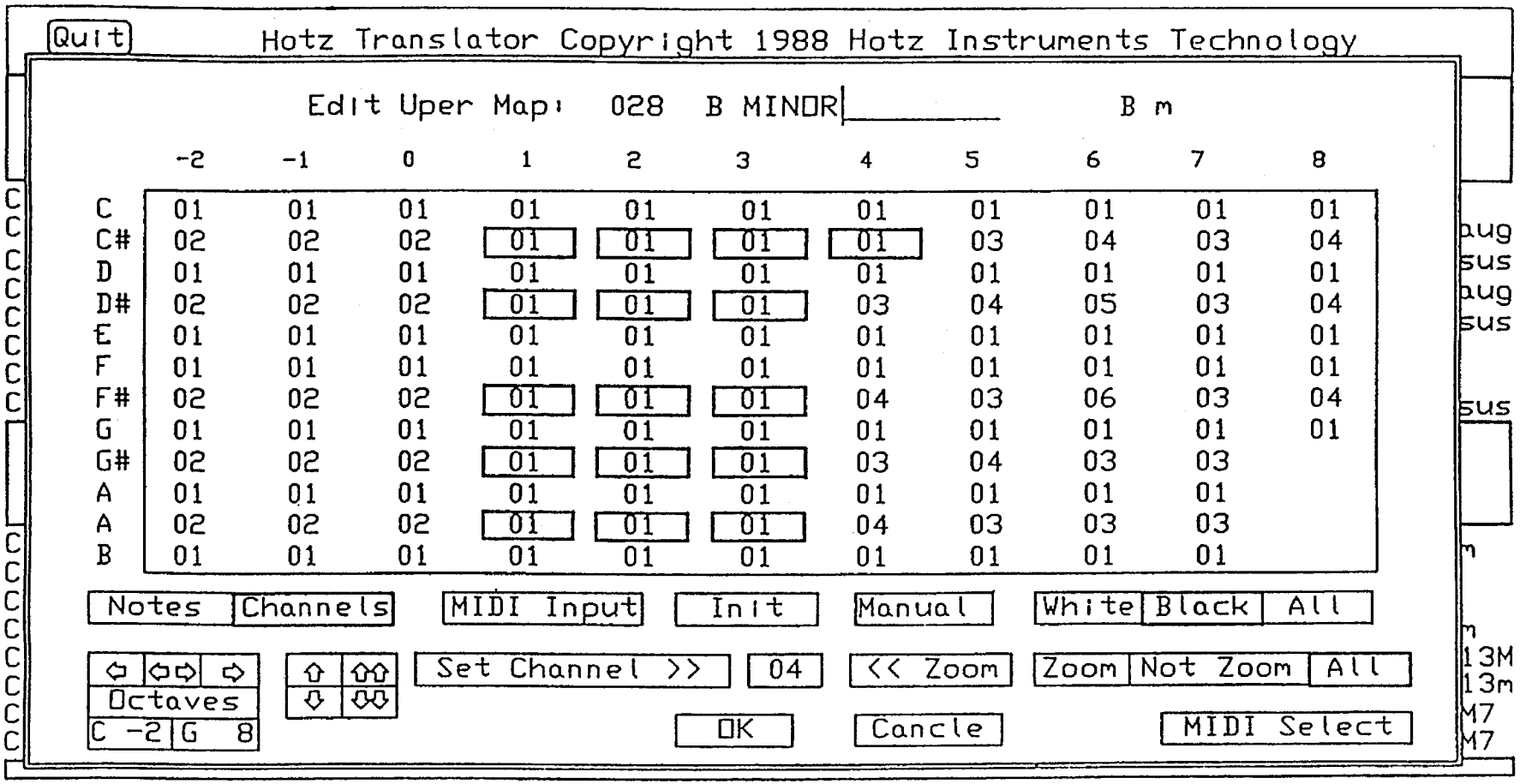
Figure 6E:
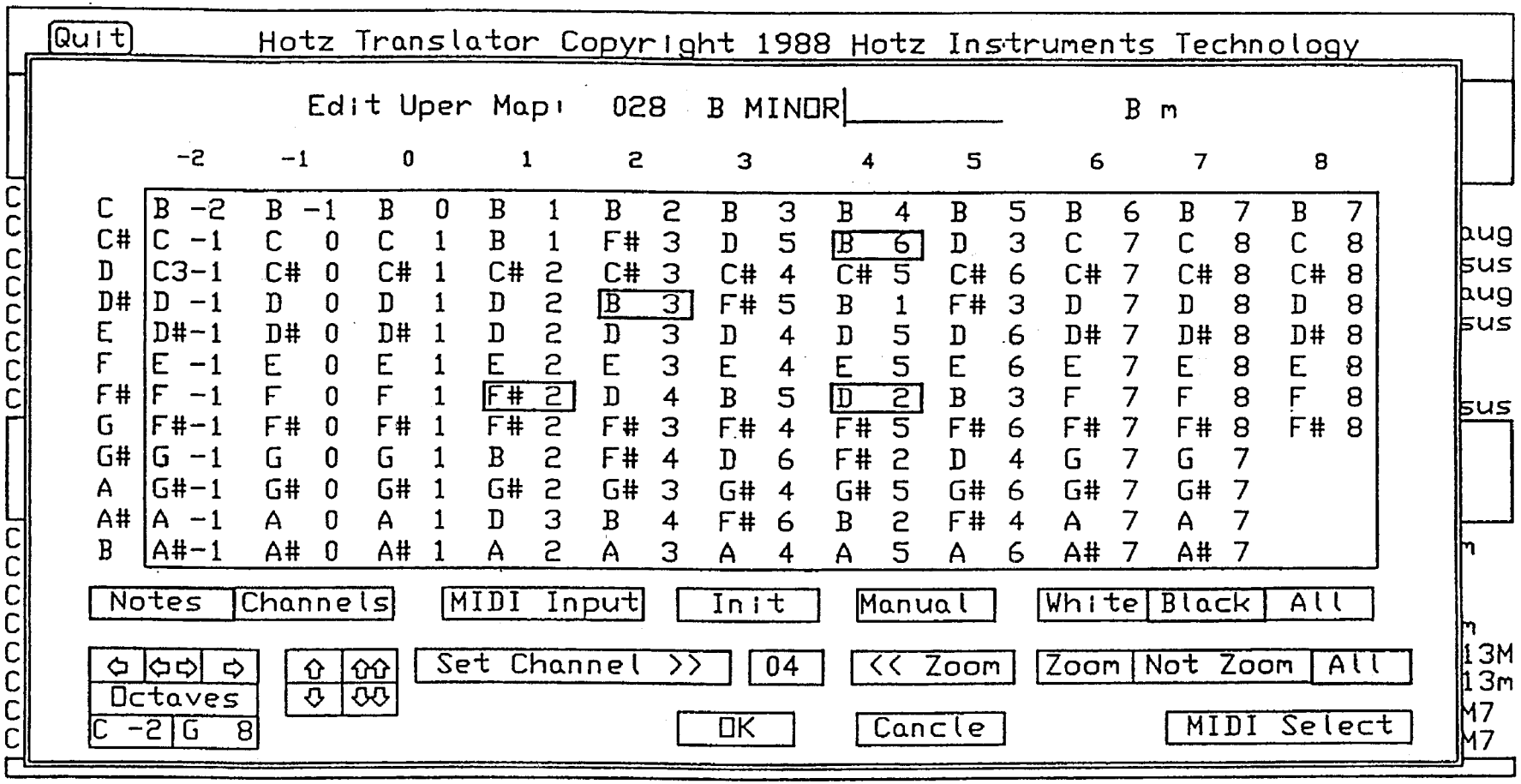
Figure 6F:
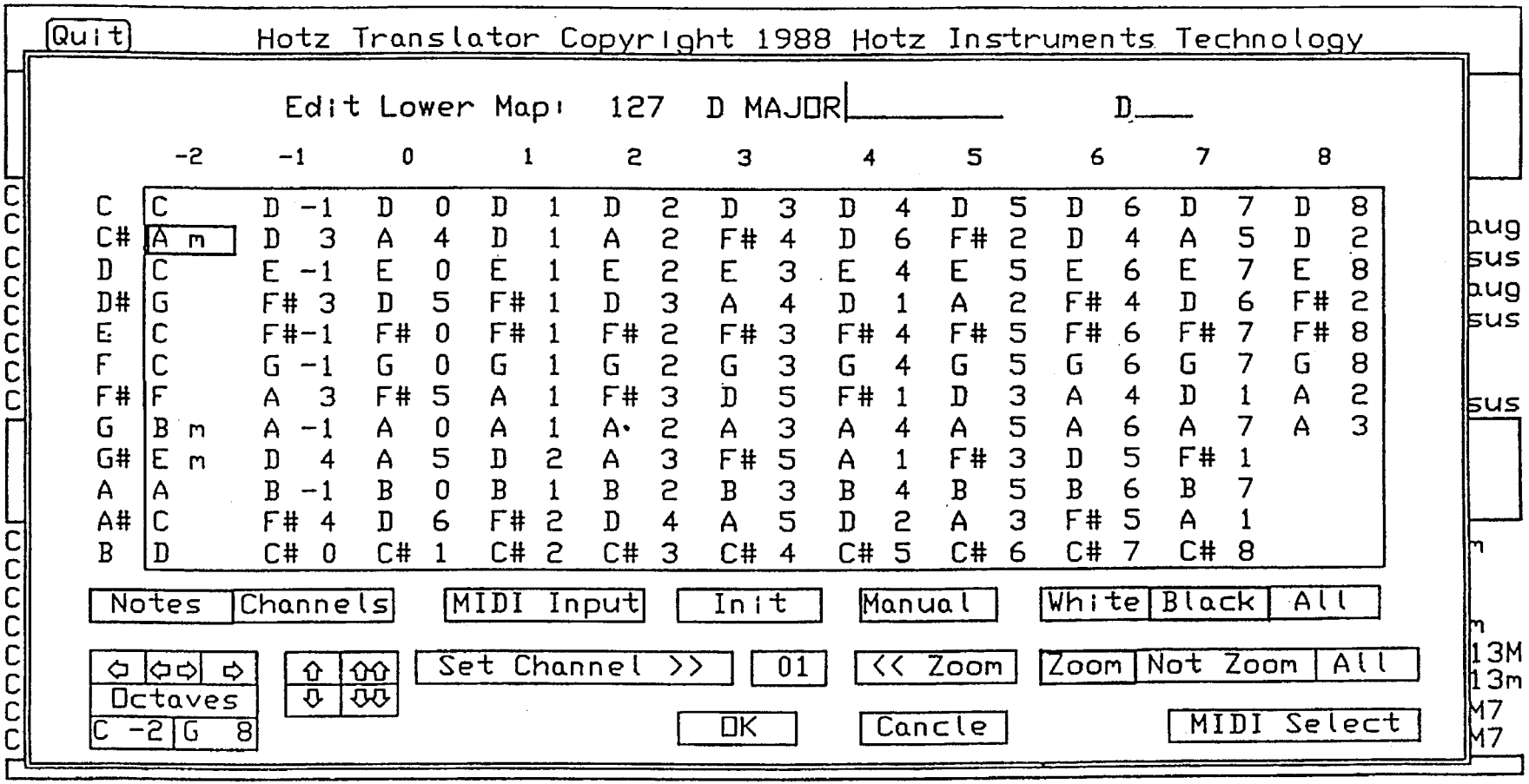
Figure 6I:
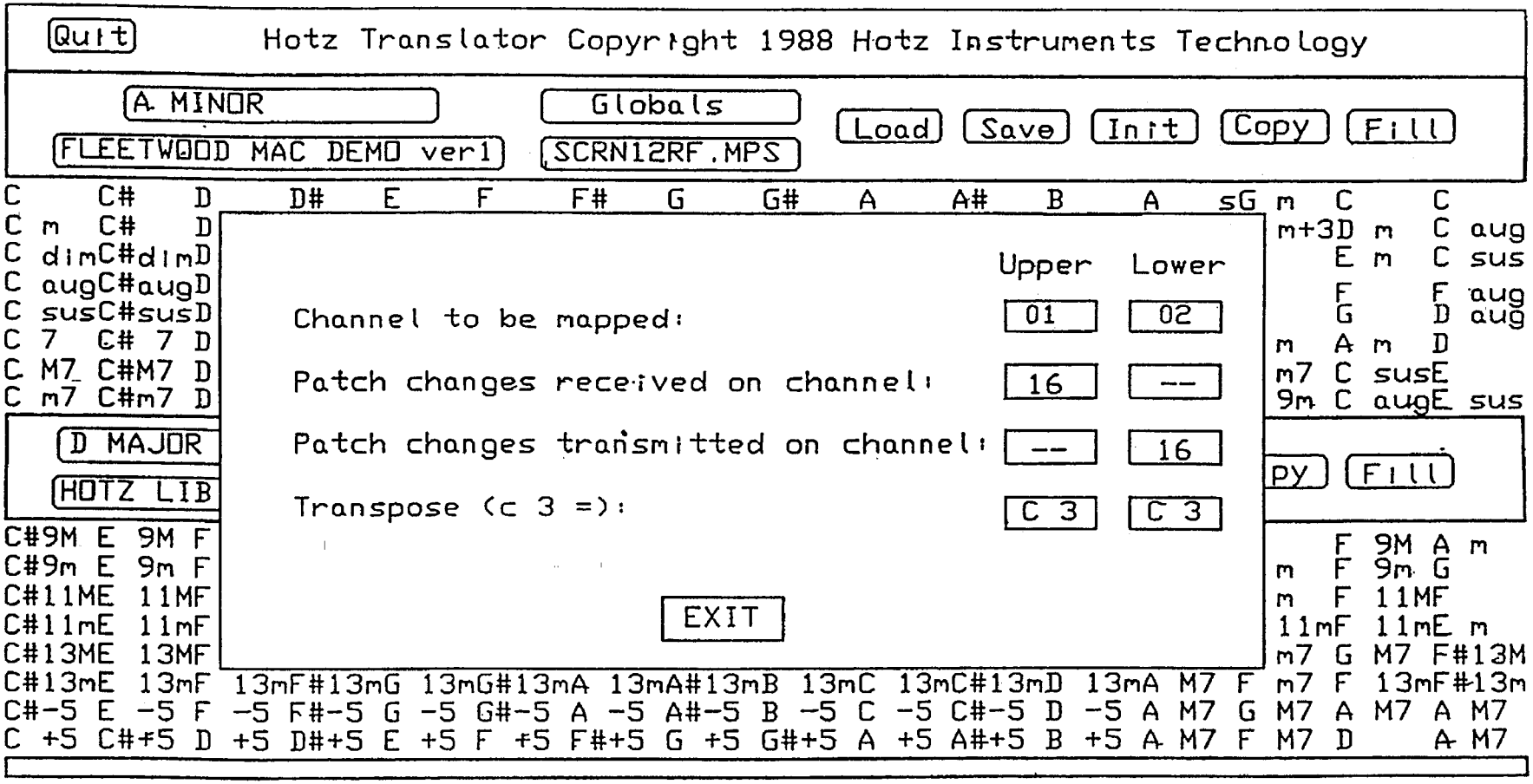

Referring now to FIG. 6*i*, the definitions of the patch changes are defined by the user. FIG. 6*i* shows that patch changes for the lower matrix are transmitted on channel 16 and patch changes for the upper matrices are received on channel 16.

Also shown in FIG. 6*i* is the transpose function, allowing a global transpose relative to the note C–3. If the note identifiers appearing in the upper and lower boxes are equal to C–3 no transposing will take place. Otherwise, all notes will be transposed up or down by the difference between the note C–3 and the contents of the upper and lower transpose boxes, allowing exploration of various keys without the need to reconfigure the tables being utilized.

Figure 6J:
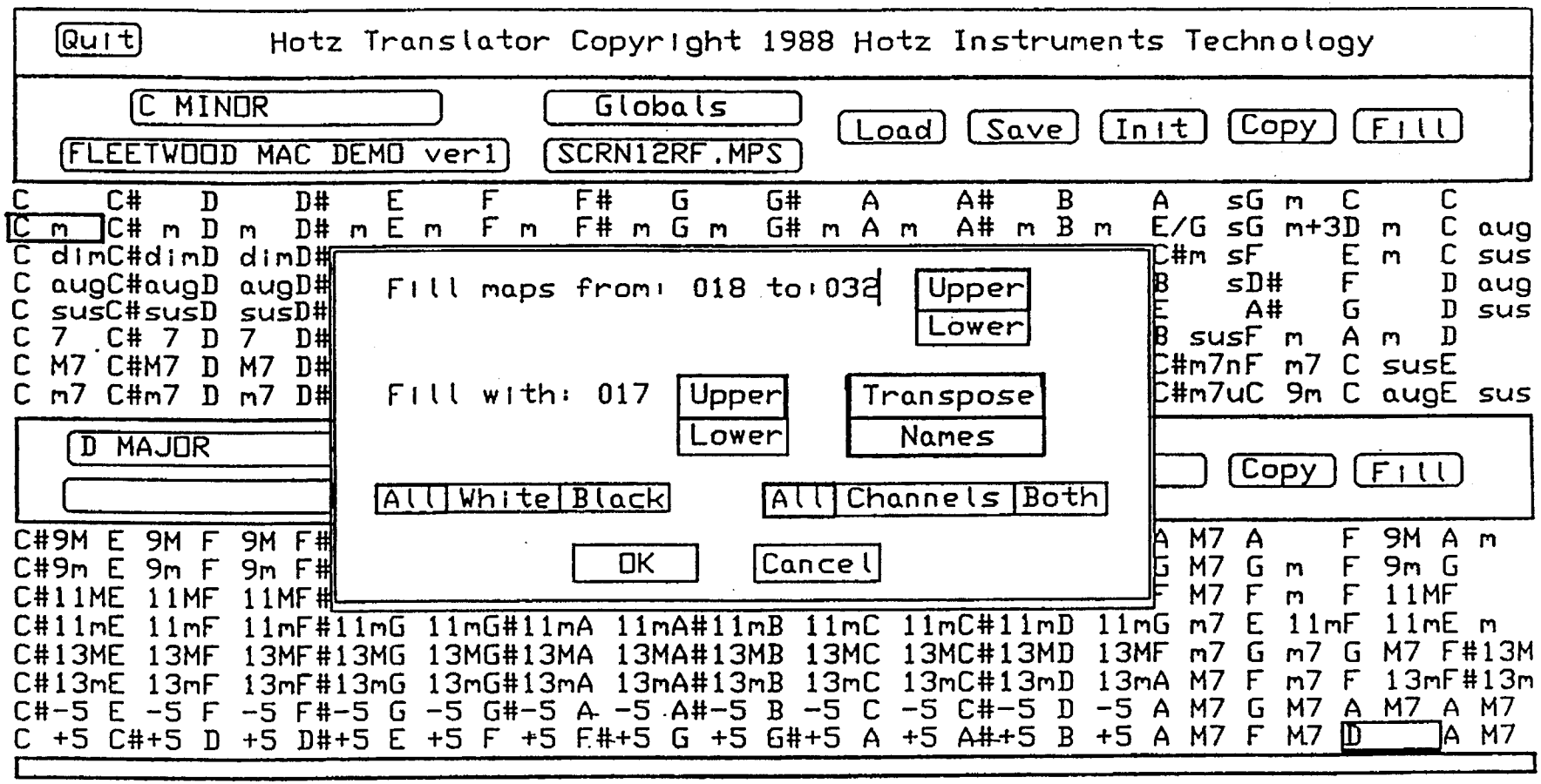

FIG. 6*j* illustrates the map filling function which allows filling the upper and lower matrices automatically. The reverse video indications show that the upper matrix from positions 18 to 32 in the matrix are to be filled with the table at MIDI number 17 in the upper matrix. It further indicates that the successive positions in the matrix are incremented by half steps and are displayed by names. Both chord and scale tables are changed; the selection of "all" "white", or "black" allows selection of chords, scales or both. Also, the name itself may be automatically transposed, thus avoiding the need to manually enter a new name in each corresponding table which has been transposed. Likewise, channel information may be selected so that a voicing arrangement may be placed on pre-existing tables without altering their note values. Alternatively, both note and channel information may be altered by selecting "both".

While a presently-preferred embodiment of the invention has been disclosed, those of ordinary skill in the art will, from an examination of the within disclosure and drawings be able to configure other embodiments of the invention. These other embodiments are intended to fall within the scope of the present invention which is to be limited only by the scope of the appended claims.

What is claimed is:

1. An electronic musical instrument comprising:

a plurality of keys including a first set of keys for generating program commands in response to being depressed, and a second set of keys for generating input device signals in response to being played;

a memory adapted to store a plurality of translation tables, said translation tables adapted to translate said input device signals received from said second set of keys for generating input device signals into corresponding control signals;

a translator to said input device signals, said translation tables and said program commands, and adapted to generate said control signals;

an electronic signal generator responsive to said control signals; and an interface for providing access between said translator and at least one external device.

2. An electronic musical instrument, according to claim 1, further including an audio subsystem that includes sound transducers for sounding notes.

3. An electronic musical instrument, according to claim 1, wherein said input device signals include identity and velocity information, said second set of keys electronically scanned to determine said identity and velocity information of the keys being played;

wherein said translator responds to said program commands by adapting said second set of keys to correspond to at least one of a plurality of translation tables in real time, said translator generating control signals based on said translation tables designated by said program commands and on said identity and velocity information received when at least one key is struck from said second set of keys; and said signal generator responding to said control signals in real time.

4. An electronic musical instrument, according to claim 3, wherein: said plurality of translation tables include a plurality of chord tables and a plurality of scale tables, one of said chord tables and one of said scale tables selected through said first set of keys; and said selected chord and scale tables enabling said translator to generate control signals based on information from said selected chord and scale tables as designated by said identity and velocity information received from at least one key from said second set of keys.

5. An electronic musical instrument, according to claim 4, wherein said information includes user defined information and received midi events from one of said at least one external devices.

6. An electronic musical instrument, according to claim 5, wherein said information includes at least one midi note information from each of said chord and scale tables and at least one velocity information from each key depressed within said second set of keys.

7. An electronic musical instrument, according to claim 1, wherein said translator includes a microprocessor, and said external device employs MIDI events.

8. An apparatus, as in claim 1, wherein said interface permits external diting through said access to said translation tables.

9. An apparatus, as in claim 1, where said interface permits reception of MIDI patch change information.

10. A method for playing an electronic musical instrument comprising the steps of:

assigning note values for each component chord note within a selected chord table and for notes within a scale table for at least one key belonging within a plurality of keys for generating input device signals;

designating a chord and scale table for said keys for generating input device signals in real time without a noticeable delay in sound output;

adapting a memory to store a plurality of translation tables, said translation tables translating input device signals generated by said keys for generating input device signals into corresponding control signals;

translating said input device signals, said tables and program commands for generating said control signals;

generating signals responsive to said control signals; and providing access between said translator and at least one external device.

11. A method for playing an electronic musical instrument, according to claim 10, wherein said keys for generating program commands providing in real time for said designation of chord and scale tables for said keys for generating input device signals.

12. A method for playing an electronic musical instrument, according to claim 10, further including designating channel information for at least one key belonging within said plurality of keys for generating input device signals.

13. An electronic musical instrument comprising:

a plurality of input devices including a first set of input devices for generating program commands in response to being depressed, said program commands including commands for selecting a chord translation table defining chord component note values for a plurality of chords and a scale translation table defining note values within a scale, and a second and third set of input devices for generating input device signals in response to being played;

means for enabling said second and third set of input devices to sound notes within a chord and scale designated by said first set of input devices, said means for enabling including at least a microprocessor, a memory, and a plurality of translation tables stored within said memory, said microprocessor controlling a plurality of scans of said plurality of input devices to receive said program commands and said input device signals, said input device signals providing signals for designating note-on and note-off flags, and said plurality of translation tables including a plurality of said chord and scale translation tables and a note velocity table;

said program commands assigning in real time a chord and scale translation table for use by said microprocessor to generate control signals, said microprocessor generating note-on control signals in response to a note-on flag, and said microprocessor generating note-off control signals in response to a note-off flag, said note-on control signals including a chord component note value from said assigned chord translation table and a note value from said assigned scale translation table, and a velocity value from said note velocity table;

an electronic signal generator responsive to said control signals; and an interface for providing access between said means for enabling and at least one external device.

14. An electronic musical instrument, according to claim 13, further including an audio means for sounding output from said signal generator.

15. An electronic musical instrument, according to claim 13, further including an external computer for editing notes within said plurality of chord and scale translation tables.

16. An electronic musical instrument, according to claim 13, wherein said chord component note, scale, and velocity values are defined in MIDI code.

17. An electronic musical instrument, according to claim 13, wherein said first set of input devices are keys for designating in real time a plurality of notes within a chord and scale through said plurality of translation tables, so as to enable said second and third set of input devices to play notes within a chord and scale designated by said first set of input devices.

* * * * *

UNITED STATES PATENT AND TRADEMARK OFFICE

CERTIFICATE OF CORRECTION

PATENT NO. : 5,619,003

DATED : April 8, 1997

INVENTOR(S) : Jimmy C. Hotz

It is certified that error appears in the above-indentified patent and that said Letters Patent is hereby corrected as shown below:

In the Specification:

Column 1, line 59: replace "snored" with --stored--.

Column 3, line 7: replace "what" with --that--.

Column 7, line 19: replace "$C_{\#}$" with --C#--.

Column 7, line 29: replace "$D_{\#}$" with --D#--.

Column 7, line 52: replace "$D_{\#}$" with --D#--.

Column 12, line 41: replace "$C_{\#}$" with --C#--.

Column 12, line 57: replace "$C_{\#}$" with --C#--.

In the Claims:

Column 13, line 64: delete the phrase "for sounding notes".

Column 14, line 36: replace "diting" with --editing--.

Signed and Sealed this

Thirtieth Day of September, 1997

*Attest:*

Bruce Lehman

BRUCE LEHMAN

*Attesting Officer*

*Commissioner of Patents and Trademarks*